US012221141B2

(12) United States Patent
Saimen et al.

(10) Patent No.: US 12,221,141 B2
(45) Date of Patent: Feb. 11, 2025

(54) ROUTE CONTROL PROGRAM GENERATION DEVICE, ROUTE CONTROL PROGRAM GENERATION METHOD AND PROGRAM

(71) Applicant: MITSUBISHI HEAVY INDUSTRIES, LTD., Tokyo (JP)

(72) Inventors: Atsuyoshi Saimen, Tokyo (JP); Takanobu Handa, Tokyo (JP); Kenji Tei, Tokyo (JP); Kengo Kuwana, Tokyo (JP); Hirotaka Okazaki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 510 days.

(21) Appl. No.: 17/619,849

(22) PCT Filed: Mar. 9, 2020

(86) PCT No.: PCT/JP2020/010012

§ 371 (c)(1),
(2) Date: Dec. 16, 2021

(87) PCT Pub. No.: WO2020/255492

PCT Pub. Date: Dec. 24, 2020

(65) Prior Publication Data

US 2022/0289258 A1 Sep. 15, 2022

(30) Foreign Application Priority Data

Jun. 18, 2019 (JP) ..... 2019-112838

(51) Int. Cl.
*G01C 21/00* (2006.01)
*B61L 27/16* (2022.01)

(52) U.S. Cl.
CPC ..... *B61L 27/16* (2022.01)

(58) Field of Classification Search
CPC ..... B61L 27/16; B61L 27/12; B61L 25/08; B61L 2019/065; B61L 23/30; G01C 21/00

(Continued)

(56) References Cited

U.S. PATENT DOCUMENTS

2015/0344050 A1* 12/2015 Yanai ..... B61L 21/04 246/3
2016/0046306 A1* 2/2016 Miyajima ..... B61L 19/06 701/19
2019/0271986 A1* 9/2019 Yamada ..... G05D 1/0217

FOREIGN PATENT DOCUMENTS

EP 2 402 229 1/2012
JP 2014-139052 7/2014

(Continued)

OTHER PUBLICATIONS

International Search Report issued on Jun. 2, 2020, in International (PCT) Application No. PCT/JP2020/010012, with Machine English-language translation.

(Continued)

*Primary Examiner* — Shardul D Patel
(74) *Attorney, Agent, or Firm* — Wenderoth, Lind & Ponack, L.L.P.

(57) ABSTRACT

A route control program generation device constructs a group of a plurality of environment models with different states in which the states of the plurality of environment models are changed in various manners. The environment model is constituted by a first moving body that is a control target and is present on a track divided into a plurality of sections, and a second moving body other than the control target, and searches for a state transition order where it is possible to achieve a request for causing the first moving body to move to a prescribed section by causing the first moving body to move to a destination while causing a state (Continued)

of one environment model to transition to a state of another environment model in response to the request. The route control program generation device constructs the group to match a prescribed restriction condition based on the restriction condition.

15 Claims, 15 Drawing Sheets

(58) Field of Classification Search
USPC ..... 701/422
See application file for complete search history.

(56) References Cited

FOREIGN PATENT DOCUMENTS

| | | |
|---|---|---|
| JP | 5881078 | 2/2016 |
| JP | 6076950 | 1/2017 |
| JP | 6080944 | 1/2017 |

OTHER PUBLICATIONS

Written Opinion of the International Searching Authority issued on Jun. 2, 2020, in International (PCT) Application No. PCT/JP2020/010012, with Machine English-language translation.

* cited by examiner

ROUTE CONTROL PROGRAM GENERATION DEVICE, ROUTE CONTROL PROGRAM GENERATION METHOD AND PROGRAM

TECHNICAL FIELD

The present invention relates to a route control program generation device, a route control program generation method, and a program.

The present application claims priority based on Japanese Patent Application No. 2019-112838 filed Jun. 18, 2019, the contents of which are incorporated herein.

BACKGROUND ART

In a railway system or a new transportation system in which a plurality of moving bodies move along track routes to their destinations, the track routes are divided into sections called blocks in order to avoid collision between the moving bodies, and control is performed to permit or inhibit entrance of the moving bodies to each block.

In order for a moving body to enter a block, it is necessary to book its entrance to the block for the moving body. The block booked for the moving body is permitted to allow only the moving body to enter it.

If the booking of the block is cancelled, the block is brought into a state in which entrance of any moving bodies is inhibited. In order for a moving body to enter the block, the booking of which has been cancelled, it is necessary to book entrance again.

In order for a certain moving body to reach a destination, it is necessary to appropriately perform control such as booking of blocks for the moving body, cancellation of booking, and moving between blocks in accordance with positional relationships and block booking conditions of all moving bodies.

In a case in which the control is not appropriately performed, a state in which both a moving body that is a control target and another moving body cannot move (deadlock) may be achieved.

In order to cause a moving body to reach a destination without bringing the moving body into a deadlock state, there is a method of designing a rule of repeating control such as block booking, cancellation of the booking, and moving between blocks and controlling the moving body in accordance with the rule. The rule will be called a route control program.

As related art, Patent Document 1 discloses a method of generating a program for controlling a train route. According to the method, a route control program is generated by specifying geometric patterns of two blocks in a railway constituted by a plurality of blocks, selecting logic to be used to determine whether or not a train can enter the blocks on the basis of the specified geometric patterns, and coupling the plurality of selected logics.

CITATION LIST

Patent Literature

[Patent Document 1]
Japanese Patent No. 6076950

SUMMARY OF INVENTION

Technical Problem

In a case in which a route control program is constructed, a method of comprehensively verifying the actions of each of moving bodies such that they reach a destination without being brought into a deadlock state may be conceived. However, an increase in the numbers of blocks and moving bodies may lead to an exponential increase in calculation cost.

The present invention provides a route control program generation device, a route control program generation method, and a program capable of solving the aforementioned problem.

Solution to Problem

According to an aspect of the present invention, a route control program generation device includes: an environment model construction unit configured to construct a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body; and a search unit configured to search for an order to reach a state of an environment model that satisfies a request for moving the first moving body to a prescribed section that is a goal without bringing the first moving body into a deadlock state with respect to the second moving body while changing the state of an environment model included in the group to a state of another environment model, and the environment model construction unit constructs the group using the state of the environment model that matches a prescribed restriction condition on the basis of the restriction condition.

According to an aspect of the present invention, a route control program generation device includes: an environment model construction unit configured to construct a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body; and a search unit configured to search for an order to reach a state of an environment model that satisfies a request for moving the first moving body to a prescribed section that is a goal without bringing the first moving body into a deadlock state with respect to the second moving body while changing the state of an environment model included in the group to a state of another environment model, and the search unit performs the searching while performing the transition to the state of the environment model that matches a prescribed restriction condition on the basis of the restriction condition.

According to an aspect of the present invention, the restriction condition is that the number of the sections to be booked is equal to or less than a prescribed value for at least one of the first moving body and the second moving body.

According to an aspect of the present invention, the restriction condition is that the number of the sections that are able to be booked at the same time for one state transition is equal to or less than a prescribed value for at least one of the first moving body and the second moving body.

According to an aspect of the present invention, the restriction condition is that the sections in a traveling direction are able to be booked while the other sections are not able to be booked for at least one of the first moving body and the second moving body.

According to an aspect of the present invention, the restriction condition is that the sections up to a prescribed value counted from the currently present section in a traveling direction are able to be booked while the other sections are not able to be booked for at least one of the first moving body and the second moving body.

According to an aspect of the present invention, when elapse of a time corresponding to a change in state of the environment model when the first moving body or the second moving body moves to an adjacent one of the sections once is defined as one logical time period, the restriction condition is that an upper limit of the number of times of booking and cancellation of the booking that are executed in the one logical time period is provided for at least one of the first moving body and the second moving body.

According to an aspect of the present invention, in a case in which the search unit is not able to search for the order to reach the state of the environment model that satisfies the request, the group of environment models is constructed by increasing the upper limit of the number of times of the execution, and the order to reach the state of the environment model that satisfies the request is searched for.

According to an aspect of the present invention, when elapse of a time corresponding to a change in state of the environment model when the first moving body or the second moving body moves to an adjacent one of the sections once is defined as one logical time period, the restriction condition is that execution of both the booking and the cancellation of the booking for one of the sections is inhibited in the one logical time period for at least one of the first moving body and the second moving body.

According to an aspect of the present invention, when elapse of a time corresponding to a change in state of the environment model when the first moving body or the second moving body moves to an adjacent one of the sections once is defined as one logical time period, the restriction condition is that execution of both the booking and the cancellation of the booking for one of the sections is inhibited in the one logical time period.

According to an aspect of the present invention, the environment model includes a plurality of second moving bodies.

According to an aspect of the present invention, a route control program generation method includes: constructing a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body; and searching for an order to reach a state of an environment model that satisfies a request for moving the first moving body to a prescribed section that is a goal without bringing the first moving body into a deadlock state with respect to the second moving body while changing the state of an environment model included in the group to a state of another environment model, and in the constructing of the group, the group is constructed using the state of the environment model that matches a prescribed restriction condition on the basis of the restriction condition.

According to an aspect of the present invention, a route control program generation method includes: constructing a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body; and searching for an order to reach a state of an environment model that satisfies a request for moving the first moving body to a prescribed section that is a goal without bringing the first moving body into a deadlock state with respect to the second moving body while changing the state of an environment model included in the group to a state of another environment model, and in the searching of the order, the searching is performed with transition to the state of the environment model that matches a prescribed restriction condition on the basis of the restriction condition.

According to an aspect of the present invention, a program causes a computer to execute: constructing a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body; and searching for an order to reach a state of an environment model that satisfies a request for moving the first moving body to a prescribed section that is a goal without bringing the first moving body into a deadlock state with respect to the second moving body while changing the state of an environment model included in the group to a state of another environment model, and in the constructing of the group, the group is constructed using the state of the environment model that matches a prescribed restriction condition on the basis of the restriction condition.

According to an aspect of the present invention, a program causes a computer to execute: constructing a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body; and searching for an order to reach a state of an environment model that satisfies a request for moving the first moving body to a prescribed section that is a goal without bringing the first moving body into a deadlock state with respect to the second moving body while changing the state of an environment model included in the group to a state of another environment model, and in the searching of the order, the searching is performed with transition to the state of the environment model that matches a prescribed restriction condition on the basis of the restriction condition.

Advantageous Effects of Invention

According to the route control program generation device, the route control program generation method, and the program described above, it is possible to reduce the calculation cost for generating a route control program.

DESCRIPTION OF EMBODIMENTS

First Embodiment

Hereinafter, a route control program generation method according to a first embodiment of the present invention will be described with reference to FIGS. 1 to 10.

Figure 1:
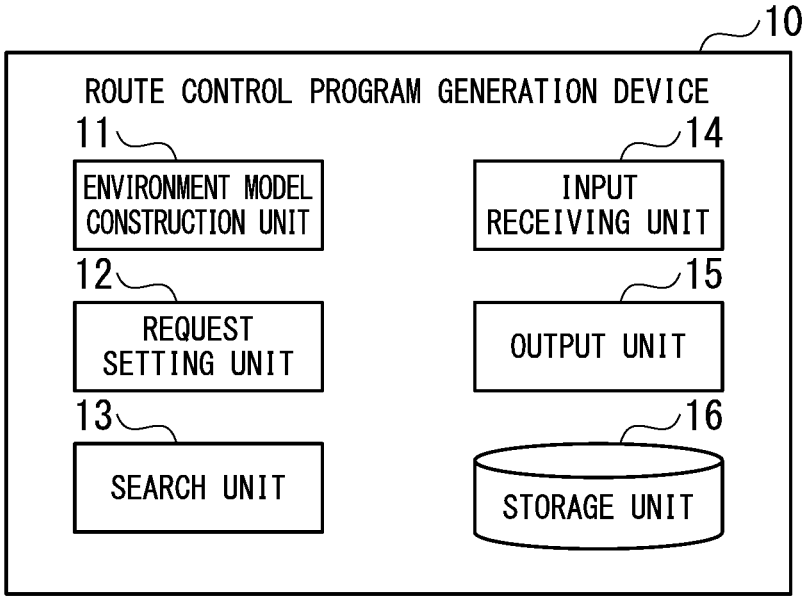
FIG. 1 is a diagram illustrating an example of a route control program generation device according to a first embodiment of the present invention.

FIG. 1 is a diagram illustrating an example of a route control program generation device according to the first embodiment of the present invention. As illustrated in FIG. 1, a route control program generation device 10 (hereinafter, referred to as a generation device 10) includes an environment model construction unit 11, a request setting unit 12, a search unit 13, an input receiving unit 14, an output unit 15, and a storage unit 16.

The environment model construction unit 11 constructs, for each moving body or for each block, a state transition system in which a moving body position or a block booking condition discretely changes depending on actions such as booking of a block, cancellation of booking of a block, and moving between blocks. Also, in the present embodiment, the environment model construction unit 11 leaves only state transition systems indicating states or state transitions that match prescribed restriction conditions and regards remaining state transition systems as environment models, from among the constructed state transition systems. The prescribed restriction conditions are, for example, the following four conditions.

Condition 1) The number of blocks booked for one moving body is equal to or less than a predefined maximum value.

Condition 2) The maximum number of blocks booked at the same time in one state transition is equal to or less than a predefined number.

Condition 3) Only blocks in a traveling direction are booked.

Condition 4) Blocks up to a predefined number counted in the traveling direction from a block that is currently in the track can be booked.

In the present embodiment, any one or more of the aforementioned restriction conditions are selected in advance, and the environment model construction unit 11 constructs environment models only with state transition systems that satisfy the selected conditions.

Figure 2:
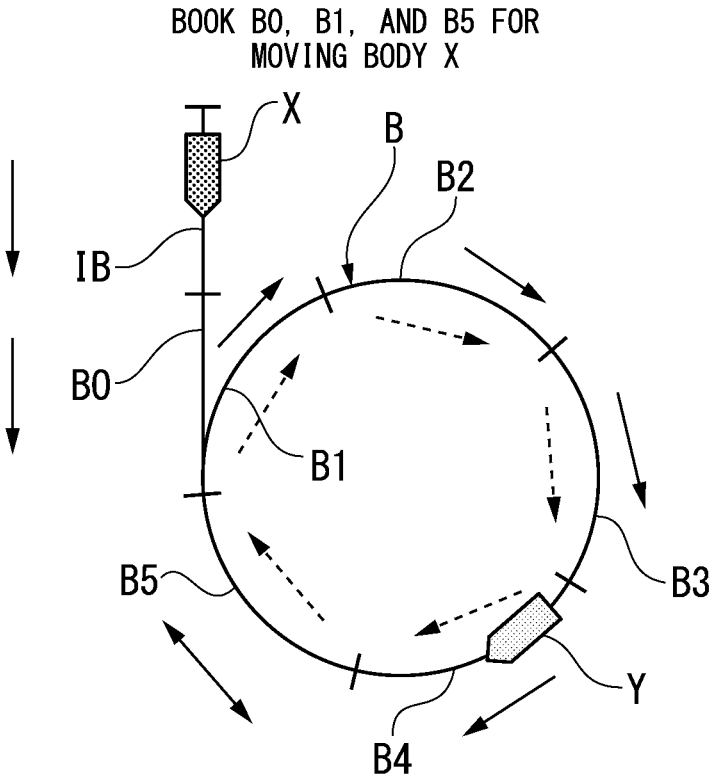
FIG. 2 is a diagram showing a state and a state transition system of an environment model according to the first embodiment of the present invention.

Here, a state and a state transition system of an environment model will be described with reference to FIG. 2. FIG. 2 is a diagram showing a state and a state transition system of an environment model according to the first embodiment of the present invention.

The environment model is constituted by a track divided into a plurality of blocks, one moving body that is present on the track and is a control target, and zero or more moving bodies that are present on the track and are not control targets. The environment model can take various forms in accordance with the position of each moving body and a booking condition for each block, and each one of the forms is referred to as a state of the environment model.

FIG. 2 illustrates an example of a state of an environment model constituted by a track B divided into blocks B0 to B5, a moving body X that is a control target, and a moving body Y that is not a control target. In the example in FIG. 2, the moving body X is present in a garage IB, and the moving body Y is present in the block B4. For the moving body X, the blocks B0, B1, and B5 have been booked. The position and the block booking conditions of the moving body X and the moving body Y can transition in various manners from the state illustrated in FIG. 2. In the present embodiment, booking of blocks for each moving body and cancellation of the booking are performed in units of blocks. One block can be booked by only one moving body at the same time, and only one moving body can be present in one block at the same time. For example, in order for the moving body X to move to the block B0, the block B0 is booked first, and then the moving body X moves to the block B0. If the moving body X books the block B0, then the moving body Y cannot book the block B0. Then, if the moving body X moves from the block B0 to another block, there is no need to book the block B0, for example, the booking of the block B0 is cancelled.

The solid line arrows indicate entrance directions of the moving body X into the blocks B0 to B5 and the dashed line arrows indicate entrance directions of the moving body Y into the blocks B0 to B5. In regard to the block B5, for example, the moving body X can move from the block B0 to the block B5 or move from the block B4 to the block B5 while the moving body Y can move only from the block B4 to the block B5.

The environment model construction unit 11 generate all patterns, for example, of the state of the environment model defined by a combination of the track B, the positions of the moving bodies X and Y, and the block booking conditions of each of the moving bodies X and Y. Although the blocks B0, B1, and B5 have been booked for the moving body X in the state in FIG. 2, for example, states of the environment model corresponding to all possible booking conditions, such as a state in which only the block B0 is booked, a state in which the block B0 and the block B1 are booked, and a state in which the blocks B0, B4, and B5 are booked are generated in addition. The environment model construction unit 11 causes blocks where the moving body X and the moving body Y are present to change, for example, and generates states of the environment model corresponding to all possible booking conditions in the positional relationship. A group of the generated multiple states of the environment model will be called a state transition system.

The request setting unit 12 sets a request in regard to moving of the moving bodies X and Y. The request is constituted by a safety condition and a goal condition. The safety condition is an inhibition condition that cannot be reached in any cases, such as a condition that "a risky result such as collision cannot be achieved regardless of movement of other moving bodies" and a condition that "deadlock that does not allow any motion cannot be achieved regardless of any control of a control target train", for example. The goal condition is a condition that has to be satisfied at some point such as a condition that "a designated station has to be reached without causing deadlock after departure from a garage", for example. The goal condition may be configured by a combination of a plurality of goal states such as a combination that "a certain intermediate state has to be satisfied, and another final state has to be achieved". In the present embodiment, it is assumed that another safety system such as signal control, for example, secures a condition that only one moving body can enter a certain block. Therefore, a request for the moving body X that is a control target to reach the destination without being brought into deadlock is set without consideration of collision of the moving body X and the moving body Y.

The search unit 13 searches for action orders of the moving bodies X and Y that satisfy the request (the safety condition and the goal condition) in the environment model (state transition system). For example, the search unit 13 associates actions such as which of the blocks is to be booked, which of the blocks booking is to be cancelled for, which of the blocks the moving body X that is a control target is to be moved to with states of the environment model illustrated as an example in FIG. 2 and causes the state of the environment model to transition to a next state of the environment model (state transition). The search unit 13 repeats the state transition until the state of the environment model that satisfies the request is achieved. A route control program is an order of state transition until the state of the environment model that satisfies the request is achieved. In other words, the route control program associates actions such as which of the blocks is to be booked, which of the blocks booking is to be cancelled for, and which of the blocks each moving body is to move to with the state of each environment model until the state of the environment model that satisfies the request is achieved from the state of the environment model at a start point.

The input receiving unit 14 receives a user's instruction operation.

The output unit 15 outputs a search result obtained by the search unit 13 to a monitor or the like.

The storage unit 16 stores the shape of the track, the number of blocks, the number of moving bodies, the restriction condition to be applied, and the like.

Here, an example of the search result obtained by the search unit 13 will be described with reference to FIGS. 3 and 4.

Figure 3:
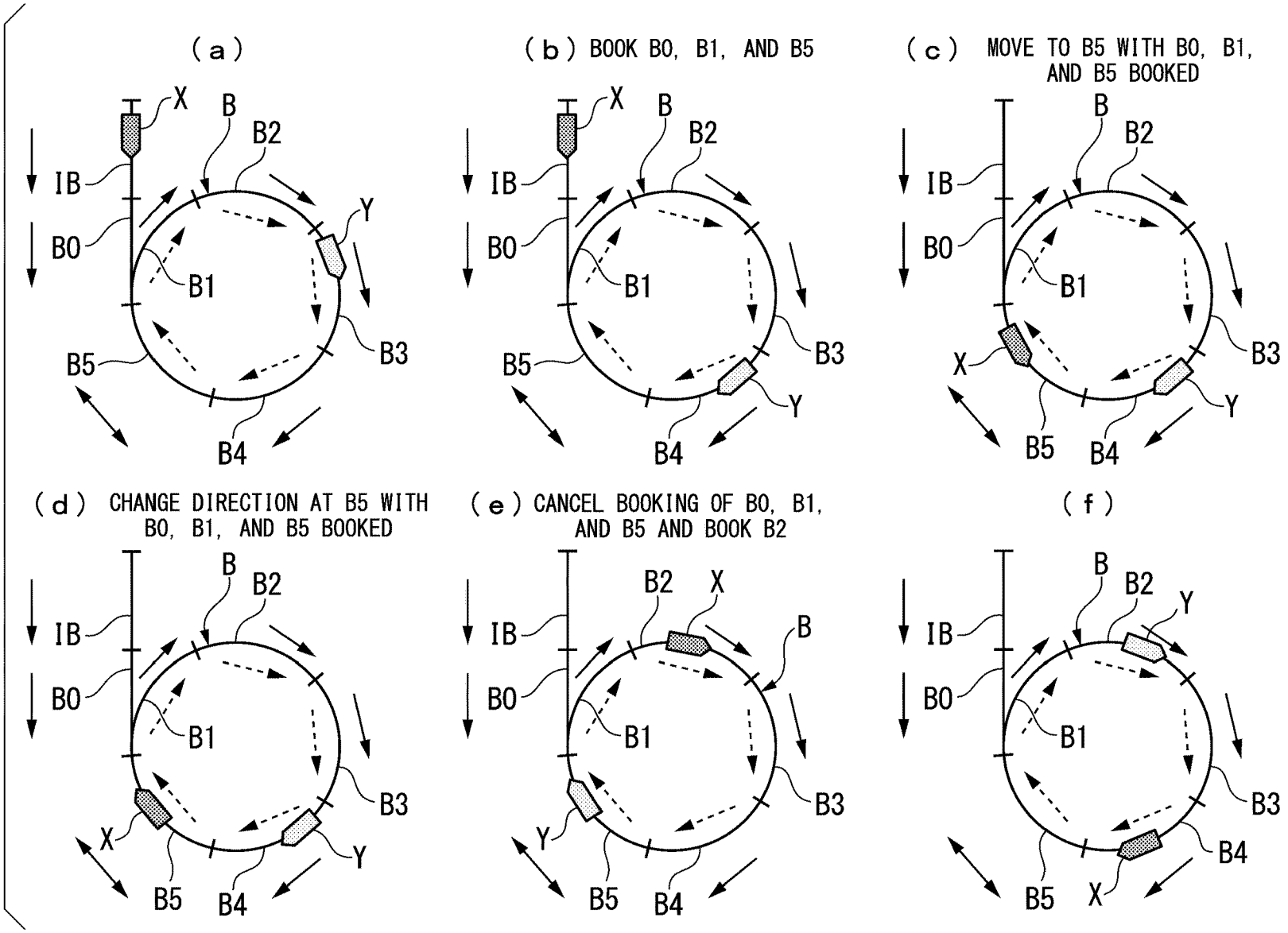
FIG. 3 is a first diagram illustrating an example of state transition according to the first embodiment of the present invention.

FIG. 3 is a first diagram illustrating an example of a state transition according to the first embodiment of the present invention. The example illustrated in FIG. 3 is an example of a state transition that satisfies a request.

Each of FIGS. 3(*a*) to 3(*f*) illustrates one state of the environment model. The search unit 13 searches for a state transition that satisfies a request for causing the moving body X to move to the block B4, which is the destination, without causing deadlock from the state in FIG. 3(*a*) in response to the request. For example, the search unit 13 associates the state in FIG. 3(*a*) with an action of booking the blocks B0, B1, and B5 for the moving body X. The state of the environment model when the action is taken is illustrated in FIG. 3(*b*). If booking, cancelation of booking, and moving are associated with such a state of the environment model, then the state of the environment model transitions. In the state illustrated in FIG. 3(*b*), the section B5 has been booked, and it is thus not possible for the moving body Y to enter the block B5, and the moving body Y waits in the block B4. Next, the search unit 13 associates the state illustrated in FIG. 3(*b*) with an action of moving to the blocks B0 and B5. The state of the environment model after the state transition through the actions is the state illustrated in FIG. 3(*c*). Next, if the moving body X changes its direction in the block B5, the state transitions to the state illustrated in FIG. 3(*d*). Next, the search unit 13 associates the state illustrated in FIG. 3(*d*) with an action of moving the moving body X to the booked block B1. Next, the search unit 13 associates an action of booking the block B2 and an action of moving to the block B2 for the moving body X in order and causes the state of the environment model to transition. Also, the booking of the blocks B0, B1, and B5 is cancelled. The environment model transitions to the state illustrated in FIG. 3(*e*) through the actions. Next, the search unit 13 associates the state illustrated in FIG. 3(*e*) with booking of the blocks B3 and B4 and moving to the blocks B3 and B4 for the moving body X and transitions to the state illustrated in FIG. 3(*f*). Each state and actions associated with each state in FIGS. 3(*a*) to 3(*f*) are the route control program.

Actions such as booking of blocks, moving, and cancellation of booking are similarly repeated for the moving body Y as well to transition the state. For example, the moving body Y moves from the block B3 to the block B4 between FIGS. 3(*a*) and 3(*b*). Thereafter, the moving body Y waits in the block B4 until the moving body X cancels the booking of the block B5. Thereafter, actions such as booking of the block B5 and moving to the block B5 and the like are associated with the moving body Y.

One state of the environment model determined by the track B divided into a plurality of blocks, the positions of the moving bodies X and Y, and blocks booked for each of the moving bodies X and Yin this manner discretely transitions to a next state in accordance with the shape of the track B, the entrance directions of the moving bodies X and Y to each block, the numbers of moving bodies X and Y and the like, the positional relationship and the destination of each moving body, and the like.

Next, another example of a state transition system will be described with reference to FIG. 4.

Figure 4:
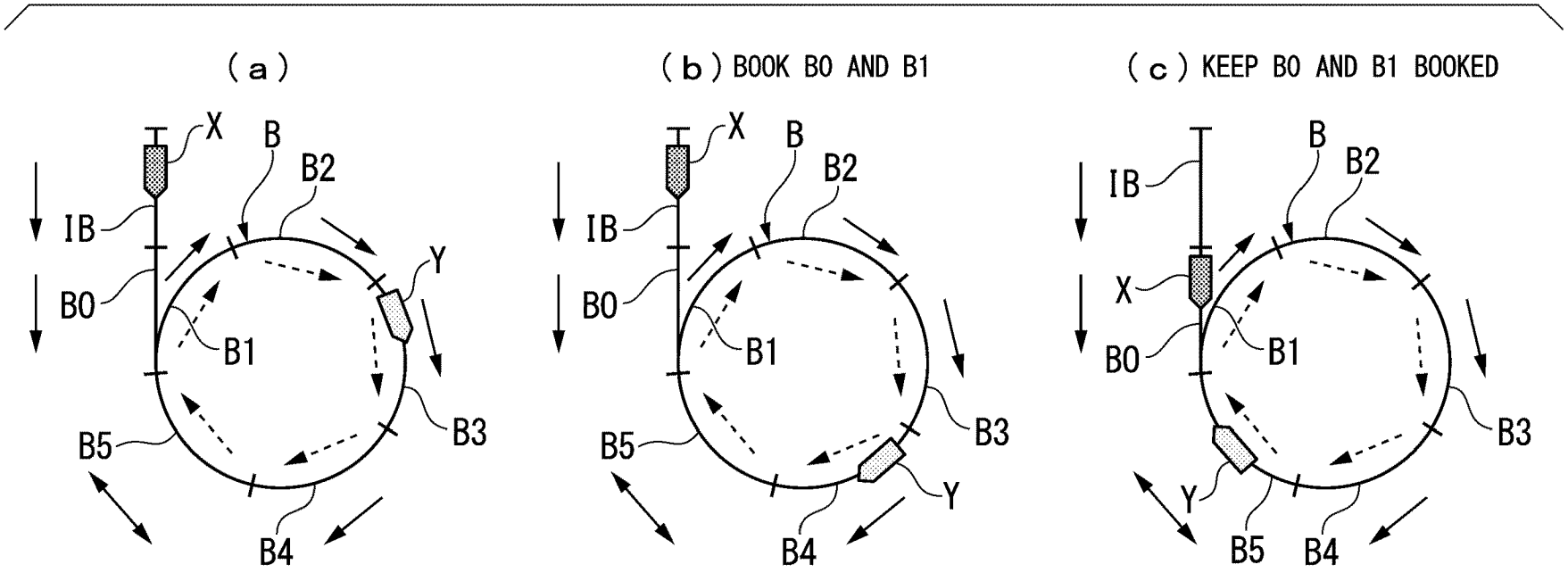
FIG. 4 is a second diagram illustrating an example of state transition according to the first embodiment of the present invention.

FIG. 4 is a second diagram illustrating an example of a state transition according to the first embodiment of the present invention.

FIGS. 4(*a*) to 4(*c*) illustrate a state transition in a case in which a deadlock state is achieved. The search unit 13 associates the state of the environment model illustrated in FIG. 4(*a*) with an action of booking the blocks B0 and B1 for the moving body X and transitions to the state illustrated in FIG. 4(*b*). Next, the search unit 13 associates the moving body X in the state in FIG. 4(*b*) with moving to the block B0 and transitions to a state in FIG. 4(*c*). Unlike the case in FIG. 2, the moving body X has not booked the block B5. Therefore, the moving body Y moves to the block B5 (FIG. 4(*c*)). Then, a deadlock state in which both the moving body X and the moving body Y cannot go ahead as illustrated in FIG. 4(*c*) is achieved. If the moving body X is brought into the deadlock state as in the example, then the search unit 13 regards the searching as a failure and stops the searching.

As described above, the search unit 13 finds an order (solution) of state transitions until the state that satisfies a request is achieved by repeating the processing of associating a certain state of the environment model with actions such as booking and moving and causing the state of the environment model to transition. Here, if the search unit 13 searches for a solution that satisfies the safety condition and the goal condition for an infinite large number of all states of the environment model as targets, excessive calculation cost is needed. Thus, only states or state transitions that match any one or more of restriction conditions described below are regarded as a search range, and then searching is performed to generate the route control program in the present embodiment.

(Restriction Condition 1)

Figure 5:
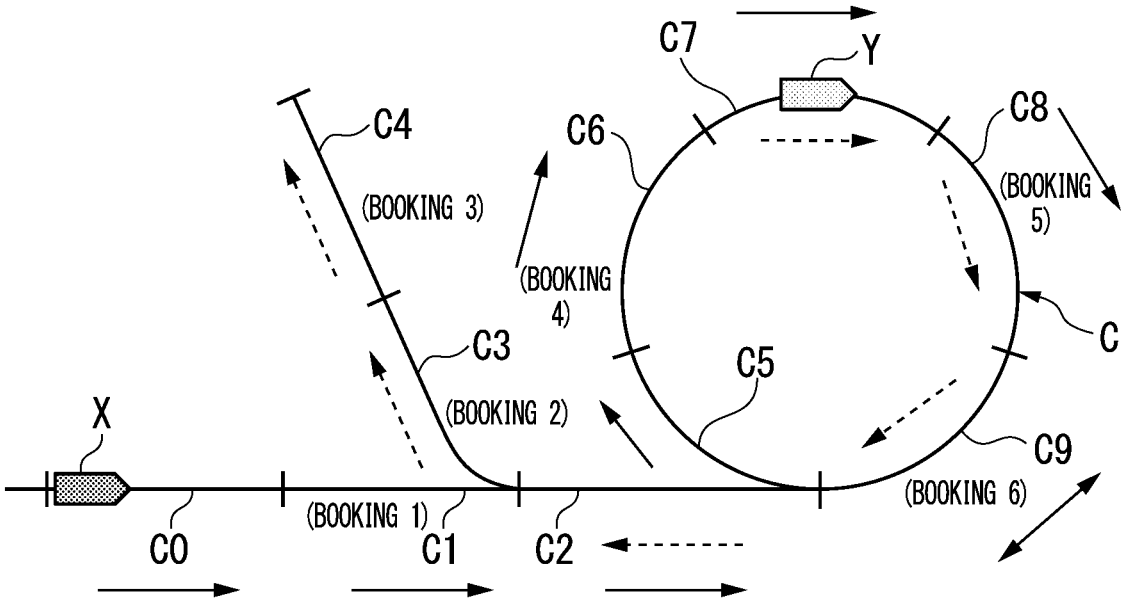
FIG. 5 is a diagram showing a first restriction condition according to the first embodiment of the present invention.

FIG. 5 is a diagram showing a first restriction condition according to the first embodiment of the present invention.

A track C is divided into blocks C0 to C9. The moving body X is present in the block C0, and the moving body Y is present in the block C7. The solid line arrows indicate entrance directions of the moving body X into each block, and the dashed line arrows indicate entrance directions of the moving body Y into each block. The environment model construction unit 11 can generate, as one state of an environment model, a state in which all blocks other than the block C7 where the moving body Y is present are booked, for example, for the moving body X. However, if all the blocks can be booked, the number of search patterns of the search unit 13 increases. Thus, in the present embodiment, upper limits are provided for the number of blocks that can be booked for the moving bodies X and Y. FIG. 5 illustrates a booking example in a case in which six blocks at a maximum can be booked at the same time. In the case of the example illustrated in FIG. 5, six blocks were booked for the moving body X, namely C1, C3, C4, C6, C8, and C9.

Here, the blocks with (BOOKING 1) to (BOOKING 6) applied thereto in FIG. 5 indicates that the blocks have already been booked. In the example illustrated in FIG. 5, the number of blocks that have been booked is six. In following FIGS. 6 to 9, the blocks with description such as (BOOKING 1) applied thereto indicate that the blocks have already been booked. The number "1" in (BOOKING 1) is applied to count the total number of the blocks that have already been booked and does not represent an order or a rank. The same applies to FIGS. 6 to 9.

(Restriction Condition 2)

Figure 6:
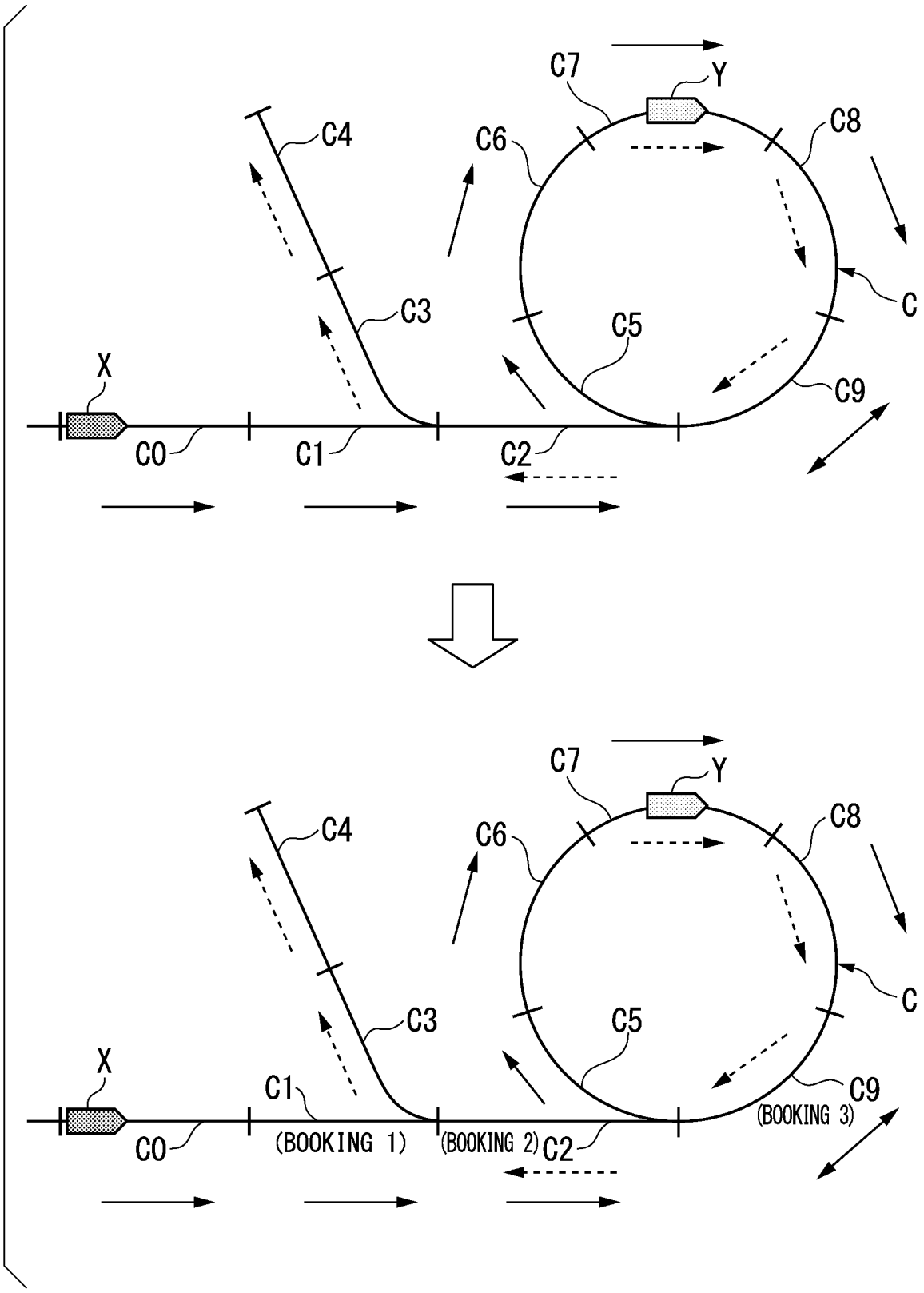
FIG. 6 is a diagram showing a second restriction condition according to the first embodiment of the present invention.

FIG. 6 is a diagram showing a second restriction condition according to the first embodiment of the present invention.

The environment model illustrated in FIG. 6 is similar to that explained in FIG. 5. The restriction condition 2 relates to the number of blocks that can be booked in one state transition. In a case in which the state in the upper view in FIG. 6 transitions to the state in the lower view, for example, an upper limit is provided for the number of blocks that can be booked for the moving body X. For example, it is assumed that the number of blocks that are booked for the moving body 1 is zero in the upper view in FIG. 6. In a case in which three has been set as the maximum number of blocks to be booked at the same time in one state transition, it is possible to book three blocks at maximum in the next state in the upper view in FIG. 6. The lower view in FIG. 6 illustrates a state after the three blocks C1, C2, and C9 are booked.

(Restriction Condition 3)

Figure 7:
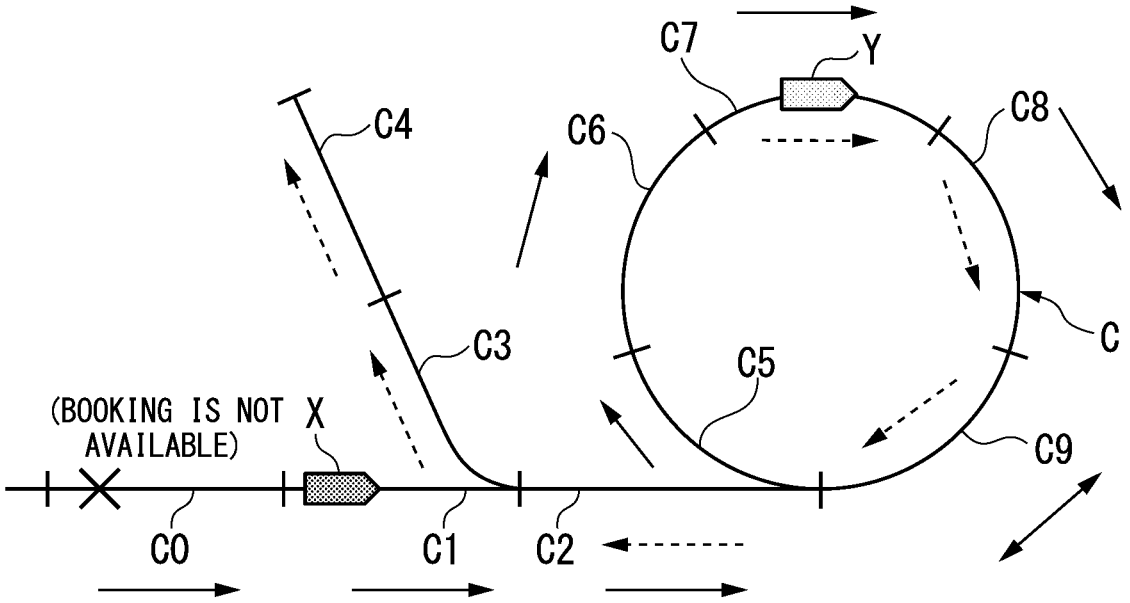
FIG. 7 is a diagram showing a third restriction condition according to the first embodiment of the present invention.

FIG. 7 is a diagram showing a third restriction condition according to the first embodiment of the present invention.

The restriction condition 3 is a condition that only blocks in the traveling direction can be booked for each moving body. According to the restriction condition, it is not possible to book the block C0 for the moving body X in the state of the environment model illustrated in FIG. 7.

(Restriction Condition 4)

Figure 8:
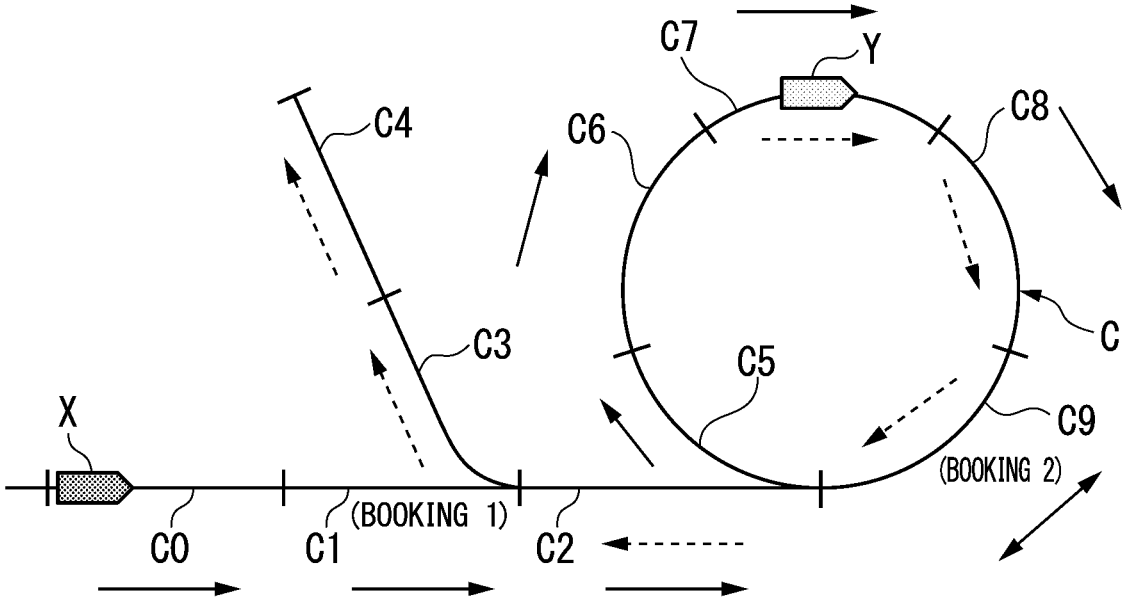
FIG. 8 is a first diagram showing a fourth restriction condition according to the first embodiment of the present invention.
Figure 9:
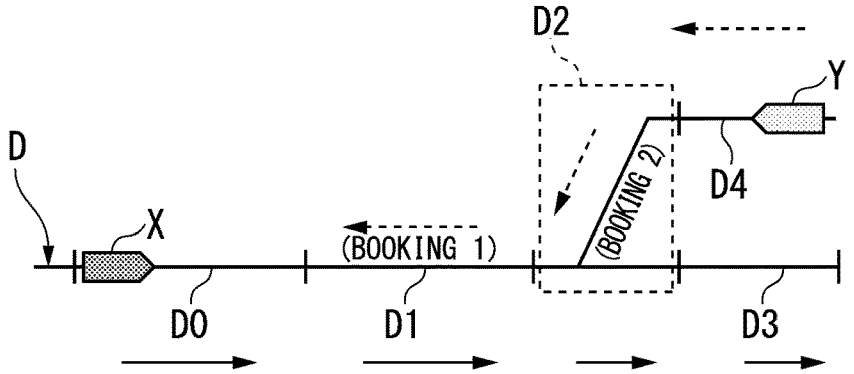
FIG. 9 is a second diagram showing the fourth restriction condition according to the first embodiment of the present invention.

FIGS. 8 and 9 are a first view and a second view showing a fourth restriction condition according to an embodiment of the present invention.

In the restriction condition 4, an upper limit is provided for a range of blocks that can be booked with reference to the current position of the moving body. In a case in which the upper limit is three, for example, the blocks C1, C2, and C9 are a range in which booking can be made for the moving body X in the state of the environment model illustrated in FIG. 8. For example, the blocks C1 and C9 can be booked for the moving body X in FIG. 8.

In regard to the restriction condition 4, the maximum number of the range of the blocks can be determined depending on the route of the moving body and the shape of the track. If the maximum number of the range of blocks is larger, it is easier to avoid deadlock while an increase in the search range of the search unit 13 leads to an increase in calculation cost. FIG. 9 illustrates another example in which the restriction condition 4 is applied. The track D illustrated as an example in FIG. 9 is divided into blocks D0 to D4. The moving body X is present in the block D0, and the moving body Y is present in the block D4. The solid line arrows indicate entrance directions of the moving body X, and the dashed line arrows indicate entrance directions of the moving body Y. In the case of the shape of the track D and the routes and the positions of the moving bodies X and Y illustrated in FIG. 9, for example, the range of the blocks that can be booked is set to be up to two blocks ahead. For example, if the moving body X books the block D1 and D2, the moving body X and the moving body Y can move in their traveling directions without being brought into a deadlock state.

Figure 10:
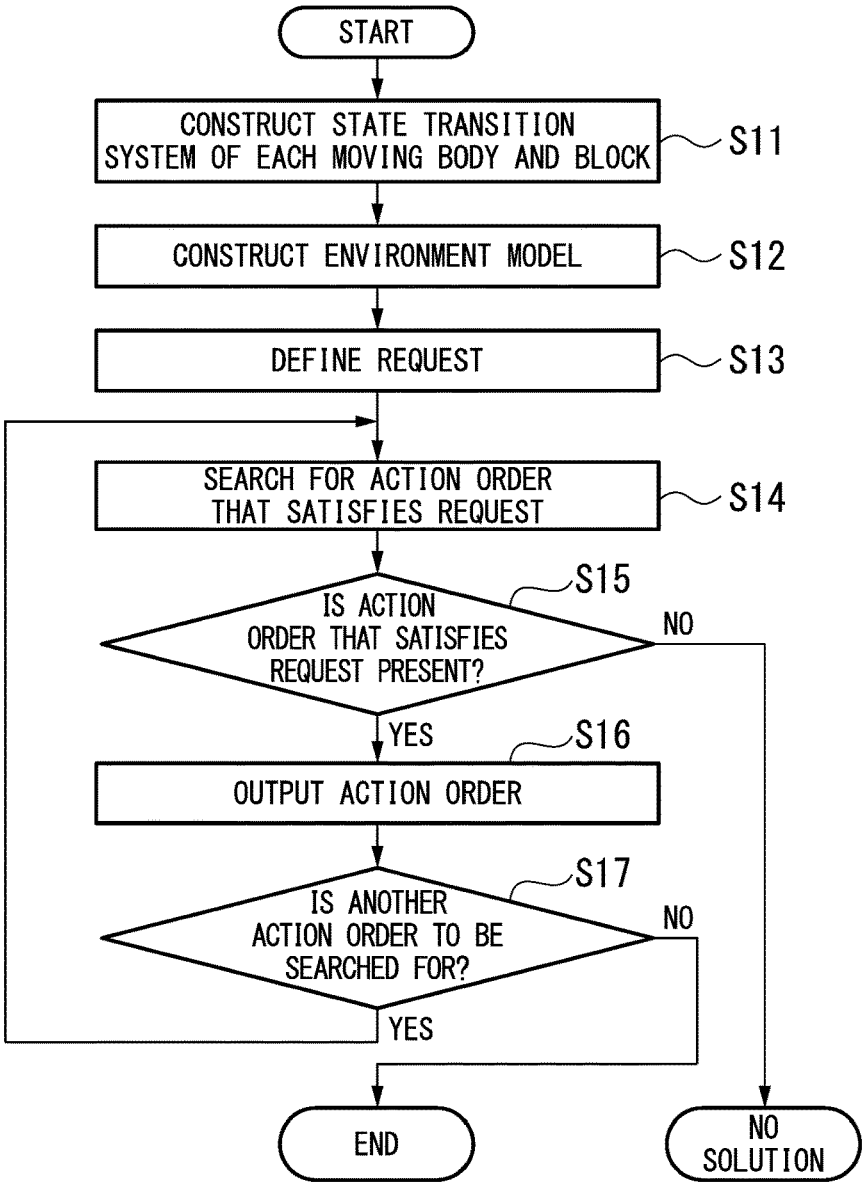
FIG. 10 is a flowchart illustrating an example of processing of generating a route control program according to the first embodiment of the present invention.

FIG. 10 is a flowchart illustrating an example of processing of generating a route control program according to the first embodiment of the present invention.

First, the environment model construction unit 11 constructs a state transition system for each moving body and for each block (Step S11). The environment model construction unit 11 comprehensively generates a state in which the positions of the moving bodies X and Y and the block booking conditions discretely change depending on booking of each block, moving, and cancellation of booking for each of the moving bodies X and Y. The multiple generated states form a state transition system.

Next, the environment model construction unit 11 constructs an environment model (Step S12). Specifically, which of the restriction conditions 1 to 4 is to be applied is set in advance, and the environment model construction unit 11 leaves only states of the environment model that satisfies the restriction condition to be applied. A group of the remaining states of the environment model is regarded as an environment model. If the upper limit value of the number of bookings for the restriction condition 1 is six, for example, the environment model construction unit 11 excludes states in which seven or more blocks have been booked for any of the moving bodies X and Y among the states generated in Step S11. For example, the environment model construction unit 11 may delete the states of the environment model that do not satisfy the restriction condition 1 or may add information indicating that the states of the environment model are targets of exclusion. The same applies to the restriction condition 3 and the restriction condition 4. In regard to the restriction condition 2 regarding a state transition, the environment model construction unit 11 may add information indicating that the transition to a state 2 is to be excluded to a state 1 if the state transition from the state 1 to the state 2 does not satisfy the restriction condition 2, for example.

Next, the request setting unit 12 sets a request regarding moving of the moving bodies X and Y (Step S13). In the example in FIGS. 2 and 3, for example, the request setting unit 12 sets no occurrence of deadlock as a safety condition and sets the destination of the moving body X as a block B4 as a goal condition. The request setting unit 12 may set an initial condition (starting from the state in FIG. 3(*a*), for example) along with the request. The safety condition, the goal condition, and the initial condition may be registered in the storage unit 16 in advance, or the user may input them to the generation device 10.

Next, the user inputs an instruction for generating a route control program to the generation device 10. The input receiving unit 14 receives the input of the instruction operation and provides an instruction for generating the program to the search unit 13. The search unit 13 searches for an action order that satisfies the request for the moving body X and the moving body Y (Step S14). As described above using FIGS. 3 and 4, the search unit 13 associates the state of the environment model indicated by the initial condition with actions such as booking of blocks, moving, and cancellation of booking, causes the state to transition, and searches for an action to be associated with each state in transition in a case in which it is possible to finally transition to the state of the environment model that satisfies the request. Next, the search unit 13 determines whether or not there is an action order that satisfies the request (Step S15). In a case in which the search unit 13 performs such searching that the state in FIG. 4(*a*) transitions to the state in FIG. 4(*b*) and then the state in FIG. 4(*c*), for example, the action order at this time is determined not to satisfy the request. In a case in which the search unit 13 performs such searching that the state in FIG. 3(*a*) transitions to each state in FIGS. 3(*b*) to 3(*f*) in this order, for example, the action order at this time is determined to satisfy the request. In a case in which the action order that satisfies the request is present (Step S15: Yes), the output unit 15 outputs the action order searched for by the search unit 13 to a monitor (Step S16). For example, the output unit 15 outputs information regarding the state of each environment model to achieve FIGS. 3(*a*) to 3(*f*) and actions associated with each state. The output information is a route control program.

Next, the user inputs whether or not to search for another action order to the generation device 10. The input receiving unit 14 receives the input of the instruction operation. In a case in which an input indicating that another action order is to be searched for is input (Step S17: Yes), the input receiving unit 14 provides an instruction for searching again to the search unit 13. The search unit 13 searches for another action order that satisfies the request for the moving body X and the moving body Y (Step S14).

In a case in which an input indicating that another action order is not to be searched for is provided (Step S17: No), the generation device 10 ends the processing of generating the route control program.

In a case in which the action order that satisfies the request is not found after searching for all patterns (Step S15: No), the search unit 13 determines that there is no solution. For example, the output unit 15 displays "no solution" on the monitor.

According to the present embodiment, it is assumed that states of the environment model are comprehensively generated, and among them, only states that match a prescribed restriction condition are regarded as targets of searching. In this manner, it is possible to generate the route control program that satisfies the request at less calculation cost than that in a case in which no restriction conditions are provided. This is advantageous to reduce calculation cost in a case in which the number of blocks and the number of moving bodies are large, in particular.

Second Embodiment

Next, processing of generating a route control program according to a second embodiment will be described with reference to FIGS. 11 and 12. In the first embodiment, reduction of calculation cost is achieved by reducing the scale of the environment model through deletion of the states of the environment model that do not match the restriction conditions 1 to 4 from the state transition system. In the second embodiment, actions of the moving bodies are searched for in a range that matches the restriction conditions 1 to 4 when a search unit 13*a* searches for an action procedure that satisfies a request.

Figure 11:
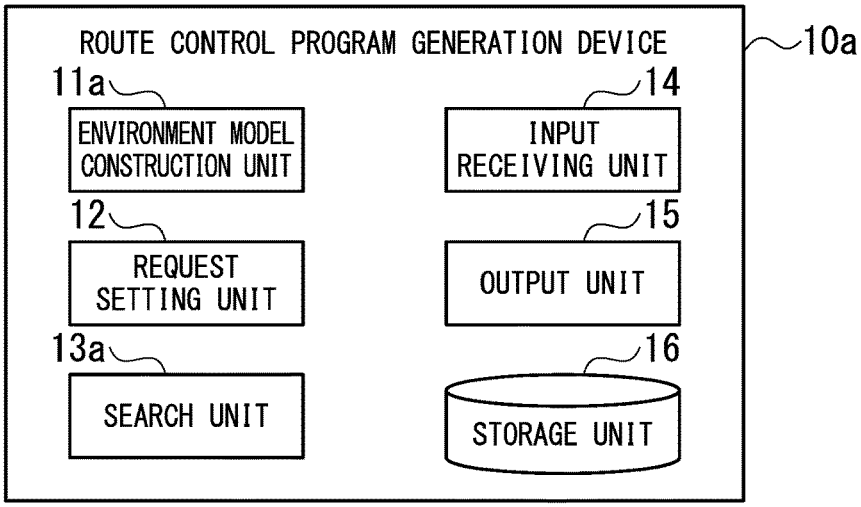
FIG. 11 is a diagram illustrating an example of a route control program generation device according to a second embodiment of the present invention.

FIG. 11 is a diagram illustrating an example of a route control program generation device according to the second embodiment of the present invention. Processing and configurations similar to those in the first embodiment will be briefly described.

The route control program generation device 10*a* includes an environment model construction unit 11*a*, a request setting unit 12, a search unit 13*a*, an input receiving unit 14, an output unit 15, and a storage unit 16.

Functions of the request setting unit 12, the input receiving unit 14, the output unit 15, and the storage unit 16 are similar to those in the first embodiment.

An environment model construction unit 11*a* constructs a state transition system constituted by a combination of all patterns of a track, positions of a moving body that is a control target and a moving body other than the control target, and booking conditions of each block. In the second embodiment, the state transition system is defined as an environment model.

The search unit 13*a* searches for an action order of the moving body that satisfies the safety condition and the goal condition in the state transition system. In the second embodiment, the search unit 13*a* applies the condition selected in advance from among the restriction conditions 1 to 4 and limits the search range at the time of searching for the action order.

Figure 12:
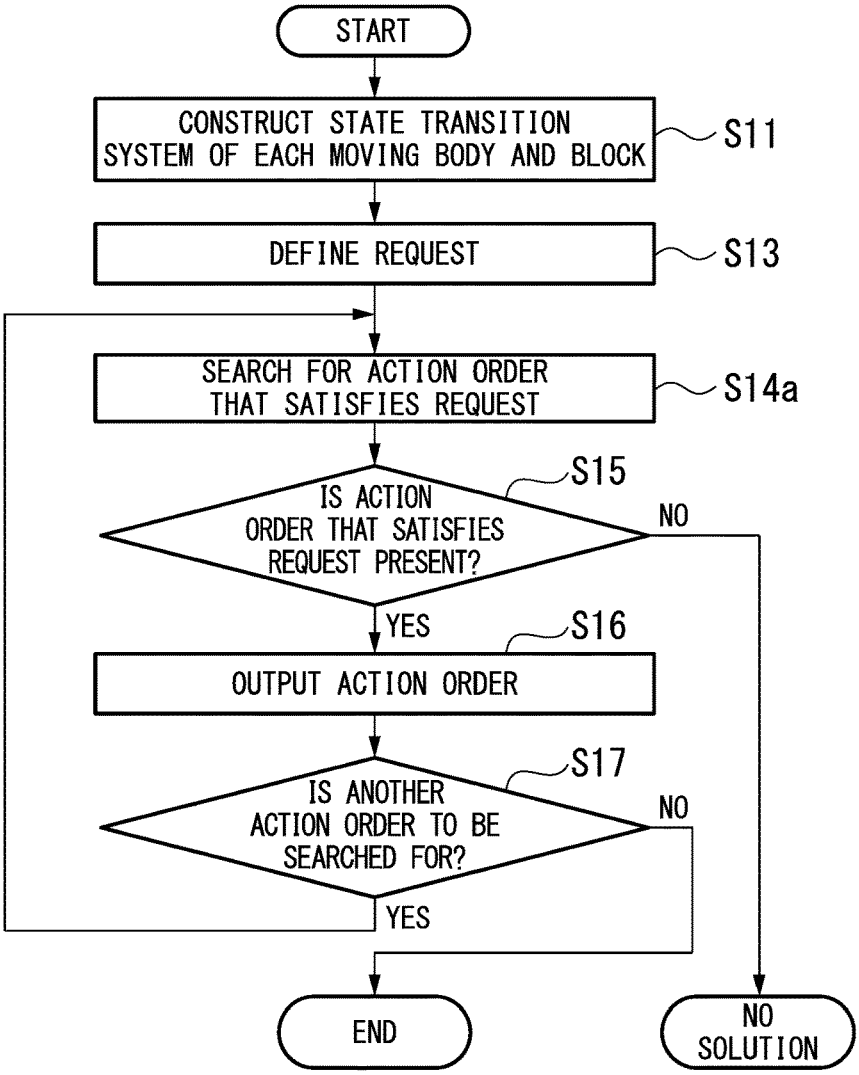
FIG. 12 is a flowchart illustrating an example of processing of generating a route control program according to the second embodiment of the present invention.

FIG. 12 is a flowchart illustrating an example of processing of generating a route control program according to the second embodiment of the present invention. Processing similar to that in the first embodiment will be briefly described.

It is assumed that which of the restriction conditions 1 to 4 is to be applied is set in advance. Alternatively, it may be set along with the request in Step S13.

First, the environment model construction unit 11*a* constructs a state transition system in which the position of each moving body and the booking condition of each block have comprehensively changed (Step S11). Next, the request setting unit 12 sets a request regarding moving of the moving body X (Step S13).

Next, the search unit 13*a* searches for an action order that satisfies the request for the moving body that is the control target and other moving bodies in response to a user's instruction or the like (Step S14*a*). Unlike the first embodiment, the search unit 13*a* performs searching with the state caused transition to match the set restriction conditions 1 to 4. In a case in which the restriction condition 1 has been set, for example, the search unit 13*a* selects a state of a transition destination from among the states of the environment model that match the restriction condition 1 when the state in FIG. 3(*a*) is caused to transition to the next state. In a case in which up to six blocks can be booked at the same time, for example, the search unit 13*a* does not associate the current state of the environment model with such an action to achieve a state in which seven blocks are booked. The same applies to the other restriction conditions 2 to 4. Next, the search unit 13*a* determines whether or not an action order that satisfies the request is present (Step S15). In a case in which the action order that satisfies the request is present (Step S15: Yes), the output unit 15 outputs the action order searched for by the search unit 13*a* to the monitor (Step S16).

In a case in which another action order is to be searched for (Step S17: Yes), the search unit 13*a* searches for another action order that satisfies the request (Step S14*a*). In a case in which another action order is not to be searched for (Step S17: No), the generation device 10*a* ends the process of generating the route control program.

In a case in which the action order that satisfies the request is not found even after all the patterns are searched for (Step S15: No), the search unit 13*a* determines that there is no solution.

According to the present embodiment, it is possible to generate a route control program secured to satisfy a request at less calculation cost similarly to the first embodiment.

Although the aforementioned embodiment has been described as an exemplary case in which the number of second moving bodies (moving bodies Y) other than the control target is one with respect to the first moving body (moving body X) that is the control target, the same applies to a case in which a plurality of second moving bodies are present on the track. In a case in which two moving bodies, namely a moving body Y and a moving body Z other than a control target are present on a track in addition to a moving body X that is the control target, for example, the generation device 10 searches for an action order by causing the state to transition under the restriction conditions 1 to 4 for the three moving bodies X, Y, and Z (first embodiment). The generation device 10*a* constructs the state transition system under the restriction conditions 1 to 4 (second embodiment). Also, although the restriction conditions 1 to 4 are applied to each of the first moving body (moving body X) and the second moving body (moving body Y) in the aforementioned embodiment, it is only necessary to apply the restriction condition 1 and the like to at least one of the first moving body and the second moving body, and in a case in which the three moving bodies X, Y, and Z (the moving body X is the first moving body, and the moving bodies Y and Z are the second moving bodies) are present on the track, for example, the searching of the action order and the construction of the state transition system may be performed by applying the restriction conditions 1 to 4 for at least one of the three moving bodies X, Y, and Z.

The fact that a plurality of second moving bodies may be present and that the restriction conditions may be applied to at least one of the first moving body and the second moving body are similarly applied to the following third embodiment and fourth embodiment.

Third Embodiment

Next, processing of generating a route control program according to a third embodiment will be described with reference to FIGS. 13 to 17 As described in the first embodiment and the second embodiment, an action order in which the moving bodies X and Y are caused to move to their destinations is searched for, and a route control program is generated, with a state of an environment model caused to change through booking of blocks, cancelation of booking, moving, and waiting in the present disclosure. Although a concept of time is not included in the route control program, it takes time to perform control to cause the moving bodies X and Y to move or wait in an actual world, and at the timing at which the moving or the waiting completes, the state of the actual environment has also changed with elapse of time required to perform the control. In other words, one state transition with the moving or the waiting of the moving bodies X and Y in the environment model accompanies elapse of actual time in practice. On the other hand, only electronic processing is required to book blocks or cancel booking, and the actions thus complete so fast that elapse of actual time can be ignored as compared with the moving or the waiting of the moving bodies X and Y. Therefore, it is possible to consider a plurality of bookings and cancelations of bookings as being able to be performed at the same time. For example, it is possible to execute multiple actions such as booking of blocks and cancelation of booking when the moving body X moves to the next adjacent block. Here, a concept of logical time period elapse will be introduced to express a discrete elapse time corresponding to a time required for actual control of the moving bodies X and Y (for example, a time required to perform control to cause the moving bodies to move to the next adjacent blocks or cause the moving bodies to stop and wait at the blocks where they are currently present) and corresponding to a transition of the state of the environment model caused by the control. One state transition due to moving or waiting corresponds to logical time period elapse of one unit, and the elapse time during this is defined as one logical time period. In the processing of searching for an action order to cause a moving body to reach its destination, actions that can be executed in one logical time period is defined to be associated with an actual time required for the moving bodies X and Y to perform moving, waiting, booking, and cancelation of booking. For example, actions that can be executed in one logical time period is a plurality of bookings of blocks, a plurality of cancelations of bookings. one movement, or one waiting. After the movement or the waiting, other actions (booking, cancelation of booking, moving, and waiting) cannot be executed. This is because actual time is needed to complete the control for the movement or the waiting and the state of the environment also transitions.

In a case in which no restrictions are provided in regard to booking of blocks and cancelation of booking that can be executed in one logical time period, the searching for actions (Step S14 in FIG. 10 or Step S14*a* in FIG. 12) may include an unnecessary search pattern such as opening of booking of a certain block right after the block is booked. "Right after the block is booked" means "before moving control of the moving body X or the like that is a control target or a state transition of another moving body Y or the like occurs after the booking control is completed". Therefore, the cancelation of booking right after the booking leads to the same result as that in a case in which no state transition has occurred, and this corresponds to unnecessary control. If the cancellation right after the booking can be searched for, it is possible to search for unnecessary control, and it takes time to calculate the route control program. The same applies to a case in which a block that has already been booked is cancelled and the same block is booked right after the cancellation. If no restriction is provided for booking and cancellation of booking that are electronic processing in this manner, unnecessary searching may occur. In the third embodiment, a restriction is provided for actions that can be executed in one logical time period when an action procedure is searched for in one logical time period (restriction condition $\alpha$). For example, an upper limit is provided for a total number of times of booking and cancellation of booking that can be executed in one logical time period to prevent unnecessary searching to occur in a non-limited manner.

Figure 13:
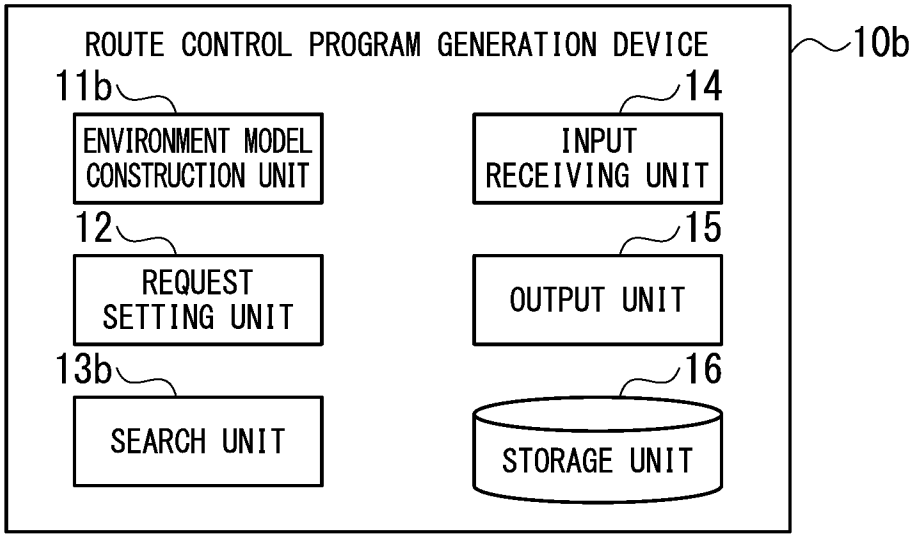
FIG. 13 is a diagram illustrating an example of a route control program generation device according to a third embodiment of the present invention.

FIG. 13 is a diagram illustrating an example of a route control program generation device according to the third embodiment of the present invention.

Processing and configurations that are similar to those in the first embodiment will be briefly described.

A route control program generation device 10*b* includes an environment model construction unit 11*b*, a request setting unit 12, a search unit 13*b*, an input receiving unit 14, an output unit 15, and a storage unit 16. Functions of the request setting unit 12, the input receiving unit 14, the output unit 15, and the storage unit 16 are similar to those in the first embodiment.

The environment model construction unit 11*b* constructs a state transition system constituted by a combination of all patterns of a track, positions of a moving body that is a control target and a moving body other than the control target, and booking conditions of each block. Further, the environment model construction unit 11*b* has a function of constructing an environment model by selecting a state that satisfies a restriction condition $\alpha$ in the constructed state transition system.

The search unit 13*b* searches for an action order of the moving bodies that satisfy a safety condition and a goal condition for the environment model constructed by the environment model construction unit 11*b*. Moreover, the search unit 13*b* has a function of searching for an action order in a limited search range, to which the restriction condition $\alpha$ is applied when the action order is searched for, as a target.

Next, the restriction condition $\alpha$ will be described with reference to FIGS. 14 and 15.

Figure 14:
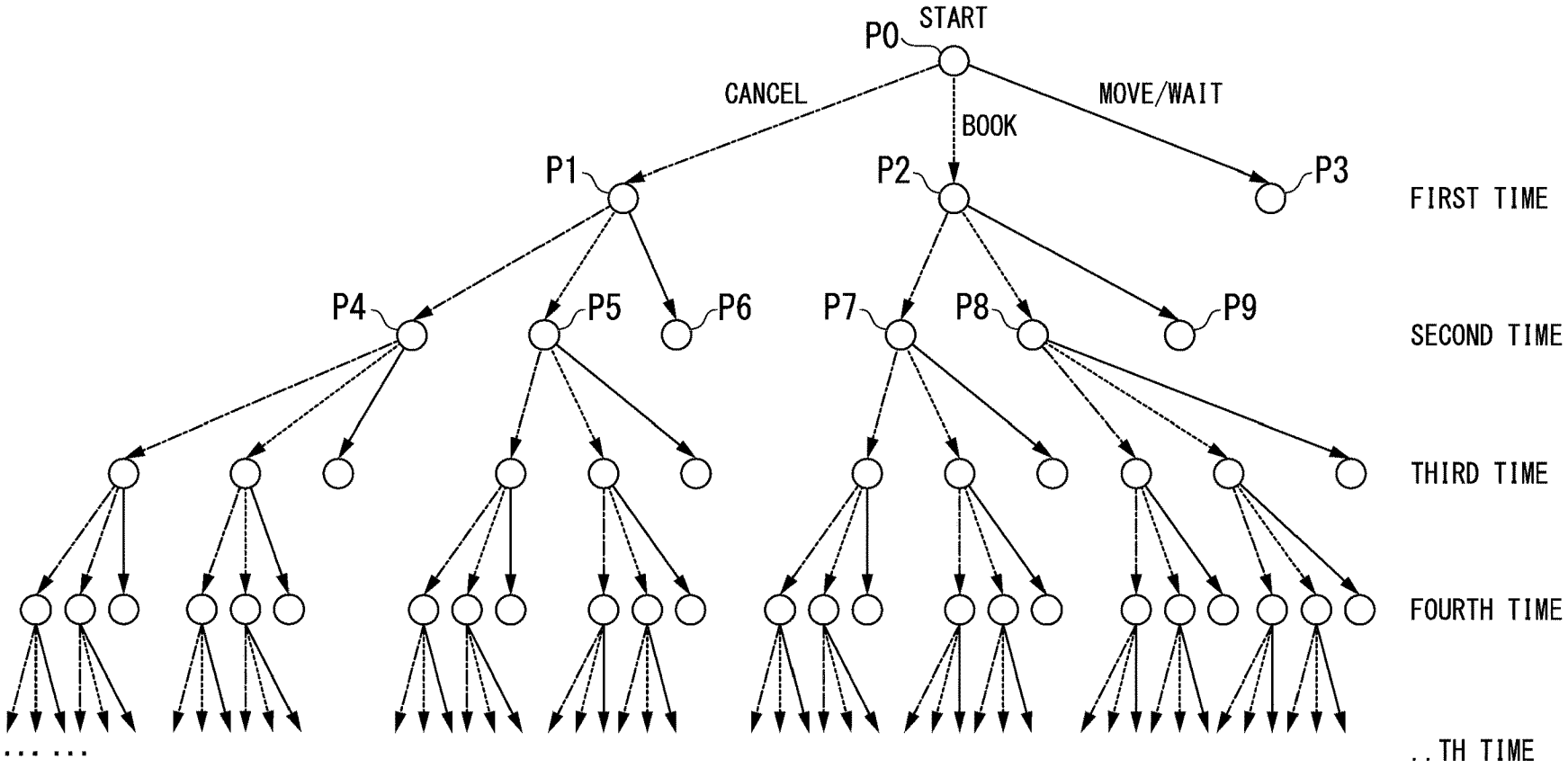
FIG. 14 is a first diagram showing a restriction condition according to the third embodiment of the present invention.
Figure 15:
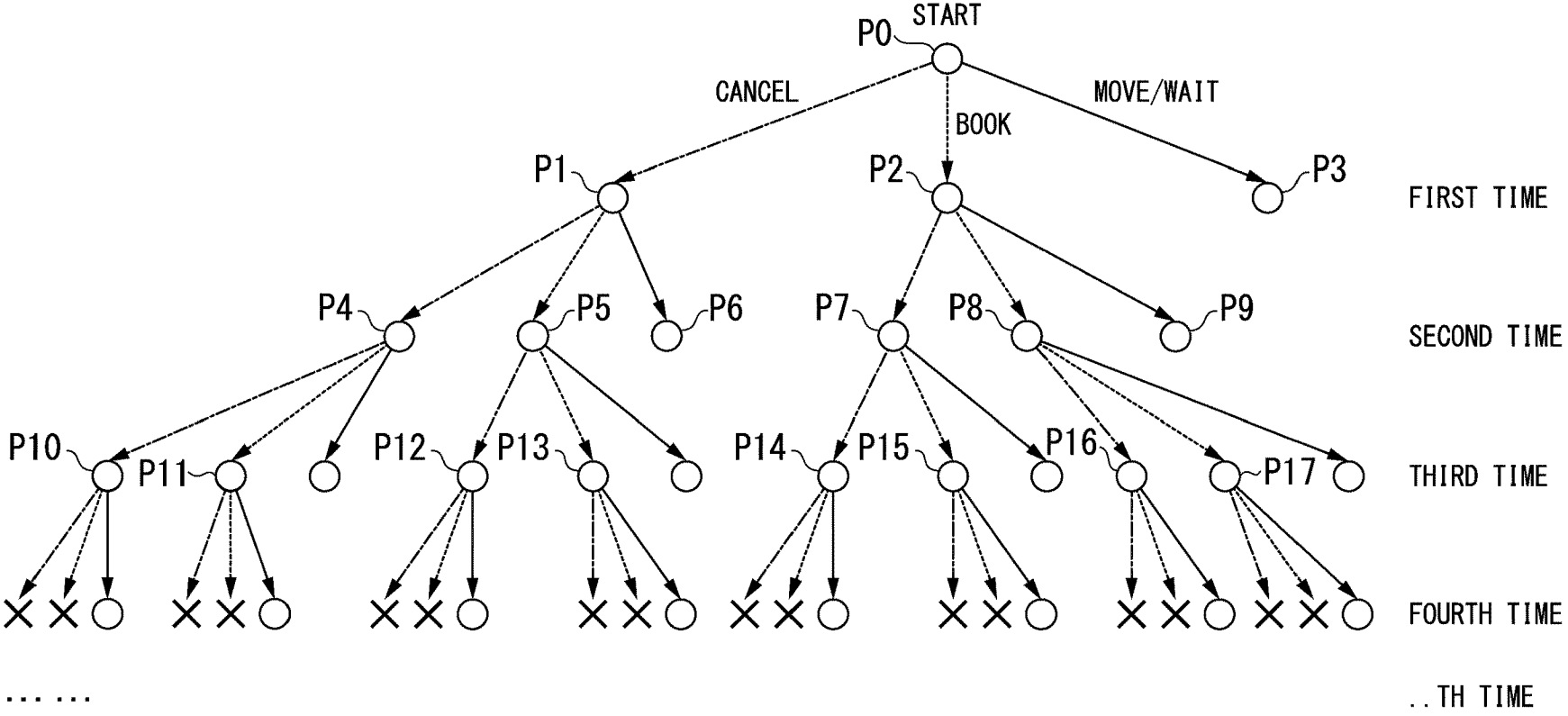
FIG. 15 is a second diagram showing the restriction condition according to the third embodiment of the present invention.

FIGS. 14 and 15 are a first diagram and a second diagram showing a restriction condition according to the third embodiment of the present invention.

FIGS. 14 and 15 illustrate a tree indicating a search path of actions in the same logical time period.

In FIGS. 14 and 15, the solid line arrows indicate movement and waiting. The dashed line arrows indicate booking of blocks. One-dotted chain line arrows indicate cancelation of booking of blocks. One solid line arrow indicates one-time movement or waiting. One dashed line arrow indicates one-time booking of one block, and one one-dotted chain line arrow indicates cancelation of one-time booking of one block that has already been booked. Indications of first, second, . . . on the right side indicate the numbers of times of actions.

FIG. 14 illustrates an example of a search path in a case in which no upper limit is provided for a total number of times of booking and cancelation of booking. In a case in which moving or waiting is selected as a first action after a start from a node P0, a node P3 is reached along the path of the solid line arrows. No path is extended from the node P3. This indicates that the one logical time period ends after the one-time movement or waiting. A node P2 is reached if booking of an arbitrary block is performed, or a node P1 is reached if cancelation of the arbitrary block that has already been booked is performed, as a first action after a start of the node P0. Since one logical time period does not complete even after the one-time booking or cancelation of booking in any cases, it is possible to select any of moving, waiting, booking, and cancellation of booking as the second action. If moving or waiting is selected as the second action in each of the nodes P1 and P2, for example, then nodes P6 and P9 are reached, and the current logical time period ends. In a case in which booking and cancelation of booking are selected as the second action in each of the nodes P1 and P2, any of nodes P4, P5, P7, and P8 is reached in accordance with a selected action. The same applies to third and following actions in FIG. 14. In a case in which no upper limit is provided for the numbers of times of booking and cancelation of booking in one logical time period, and an action selected in each node is booking or cancelation of booking, the tree illustrated as an example in FIG. 14 can expand with no limits. In order to prevent this, an upper limit is provided for a total value of the number of times of booking and the number of times of cancellation of booking in one logical time period.

FIG. 15 illustrates a tree of a search path when an upper limit of the total number of times of booking and cancellation of booking is set to three. In a case in which the upper limit is set to three, the node P1 is reached by selecting cancellation of booking as the first action from the node P0, the node P4 is reached by selecting cancellation of booking as the second action, and the node P10 is reached by performing cancellation of booking as the third action, the cancellation of booking has already been performed three times, and it is thus not possible to perform booking, cancellation of booking, and moving or waiting any more in the logical time period, and the logical time period then ends. This state is represented by x marks. The x marks indicate that it is not possible to reach the nodes. In a case in which the node P1 is reached by selecting cancellation of booking as the first action from the node P0, the node P5 is reached by selecting booking as the second action, and the node P12 is reached by performing cancellation of booking as the third action, for example, booking has been performed once, cancellation of booking has been performed twice, the total number of times of the booking and the cancellation of booking has reached the upper limit, namely three, and it is thus not possible to perform the booking and the cancellation of booking any more. The same applies to other nodes P11 and P13 to P17. It is possible to prevent an increase in search path by providing the upper limit for the total number of times of booking and cancellation of booking in this manner. The restriction condition $\alpha$ is that the upper limit is provided for the total number of times of booking and cancellation of booking. The restriction condition $\alpha$ is applied to at least one of the moving bodies X and Y.

Although the upper limit may be set in advance for the total number of times of booking and cancellation of booking, the upper limit may be defined as follows. In other words, although it is necessary for a designer to appropriately set the upper limit of the total number of times depending on how complicated the route is, such as the number of continuous branched blocks, it is difficult for a person to appropriately set a specific number of times under an environment condition under which it is possible to perform control including an enormous number of combination patterns. Thus, in a case in which the upper limit value of the total number of times is one first and there is no solution for the route control program, the upper limit value of the total number of times is incremented by a prescribed value (one, for example) until the solution is obtained. It is possible to obtain a solution (action procedure) that satisfies the safety condition and the goal condition and minimizes unnecessary actions at the minimum upper limit value with which a solution can be obtained by setting an upper limit value in this manner.

Figure 16:
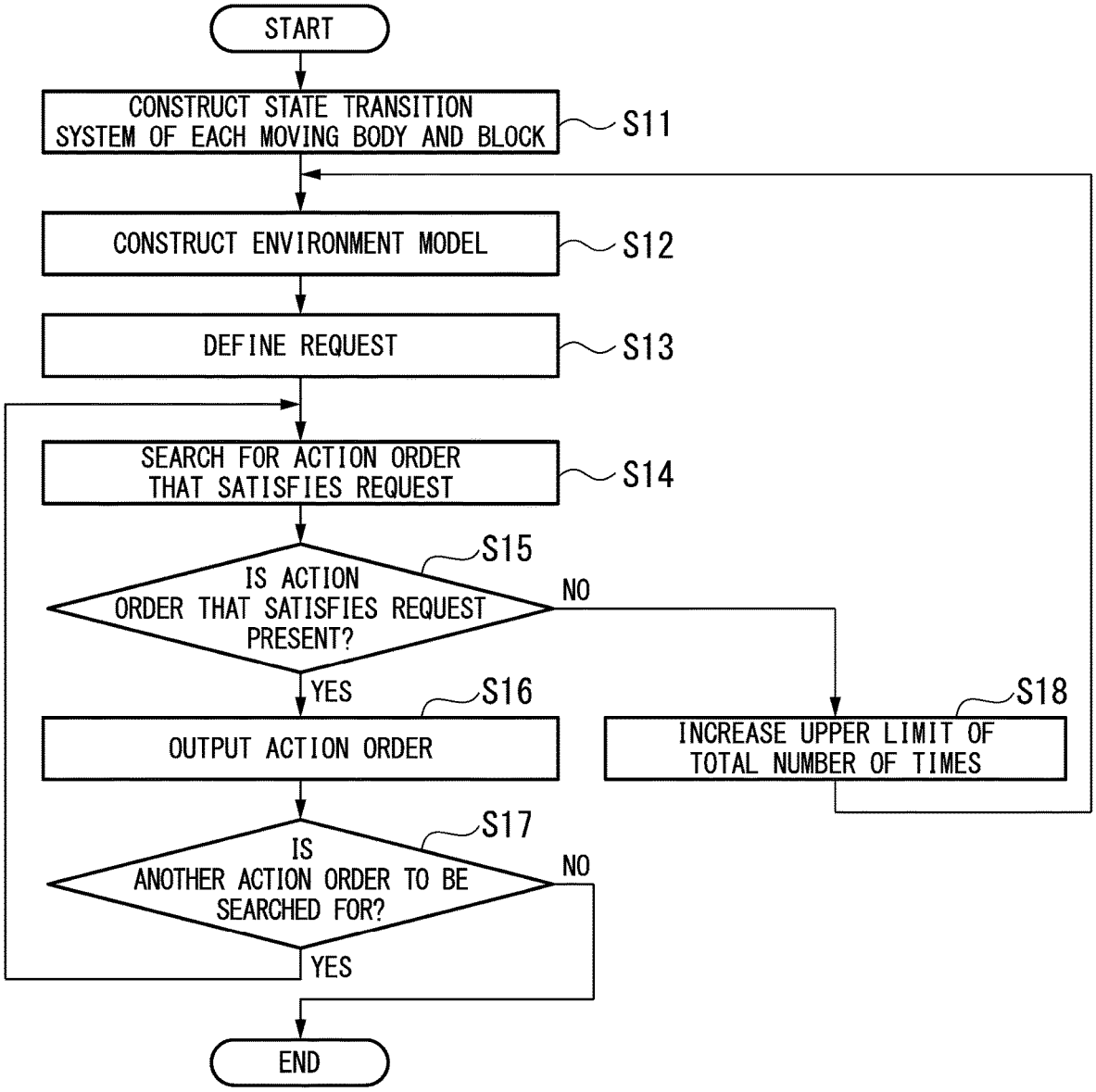
FIG. 16 is a first flowchart illustrating an example of processing of generating a route control program according to the third embodiment of the present invention.

FIG. 16 is a first flowchart illustrating an example of processing of generating a route control program according to the third embodiment of the present invention. Processing that is similar to that in the first embodiment will be briefly described. One is set, for example, as an initial value of the upper limit value of the total number of times of booking and cancellation of booking.

First, the environment model construction unit 11 constructs a state transition system in which the position of each moving body and the booking conditions of each block are comprehensively changed (Step S11). The environment model construction unit 11 records the entire constructed state transition system in the storage unit 16. Next, the environment model construction unit 11 constructs an environment model (Step S12). When a time during which a state of an environment model transitions once through one-time movement or waiting is defined as one logical time period in the state transition system constructed in Step S11, the environment model construction unit 11 leaves only the state of the environment model that satisfies a request for actions that can be executed in one logical time period for at least one of the moving bodies X and Y. The request for actions that can be executed in one logical time period is booking of blocks within the upper limit value, cancellation of booking, and one-time movement or waiting. In regard to one-time movement or waiting, it is possible to perform booking or cancellation of booking the number of times that is less than the upper limit value before the movement or the waiting, but booking and cancellation of booking cannot be executed after the one-time movement or waiting. A group of remaining states of the environment model is defined as an environment model. In a case in which the upper limit value of the total number of times of booking and cancellation of booking is one, for example, it is not possible to take an action to reach any node ahead from the nodes P1 and P2 in FIG. 15. The environment model construction unit 11 excludes states including results of such actions. For example, the environment model construction unit 11 may delete states of the environment model in which the upper limit value of the total number of times exceeds one or may add information indicating that the states of the environment model are targets of exclusion.

Next, the request setting unit 12 sets a request in regard to movement of the moving bodies X and Y (Step S13). Next, the search unit 13*b* searches for an action order that satisfies the request for the moving body X that is a control target and another moving body Y (Step S14). Next, the search unit 13*b* determines whether or not an action order that satisfies the request is present (Step S15). In a case in which an action order that satisfies the request is present (Step S15: Yes), the output unit 15 outputs the action order searched for by the search unit 13*b* to the monitor (Step S16). In a case in which another action order is to be searched for (Step S17: Yes), the search unit 13*b* searches for another action order that satisfies the request (Step S14). In a case in which another action order is not to be searched for (Step S17: No), the generation device 10*b* ends the processing of generating the route control program.

In a case in which an action order that satisfies the request is not found even after all the patterns are searched for (Step S15: No), the search unit 13*b* determines that there is no solution. In the case of no solution, the generation device 10*b* (for example, the environment model construction unit 11*b*) adds one to the upper limit value of the total number of times of booking and cancellation of booking. Then, the processing in and after Step S12 is repeated again. For example, the environment model construction unit 11*b* reads a state transition system saved in the storage unit 16, deletes states of the environment including a state in which the upper limit value of the total number of times of booking and cancellation of booking exceeds the value after the addition, and construct an environment model in Step S12. Then, the generation device 10*b* executes the processing in and after Step S13.

According to the present embodiment, occurrence of booking of each block and cancellation of booking in one logical time period is counted, and in a case in which the total number reaches a specific number of times (upper limit value), any more occurrence of booking or cancellation of booking is inhibited in the same logical time period. It is thus possible to prevent occurrence of a search pattern in which booking and cancellation of booking are infinitely and unlimitedly repeated for the same block, for example. It is possible to prevent occurrence of an unnecessary search pattern in which all the blocks are booked by the moving body X and the moving body Y cannot move, for example, by providing the upper limit of the total number of times of booking and cancellation of booking. According to the present embodiment, the search space is reduced, and it is thus possible to shorten the calculation time in this manner.

The third embodiment can be combined with the first embodiment. In other words, the environment model construction unit 11*b* may leave only states that satisfy any or all of the restriction conditions 1 to 4 described in the first embodiment in addition to the restriction condition α and construct an environment model in Step S12 in the flowchart in FIG. 16.

The third embodiment can be combined with the second embodiment. Processing in the case of the combination with the second embodiment is illustrated in FIG. 17.

Figure 17:
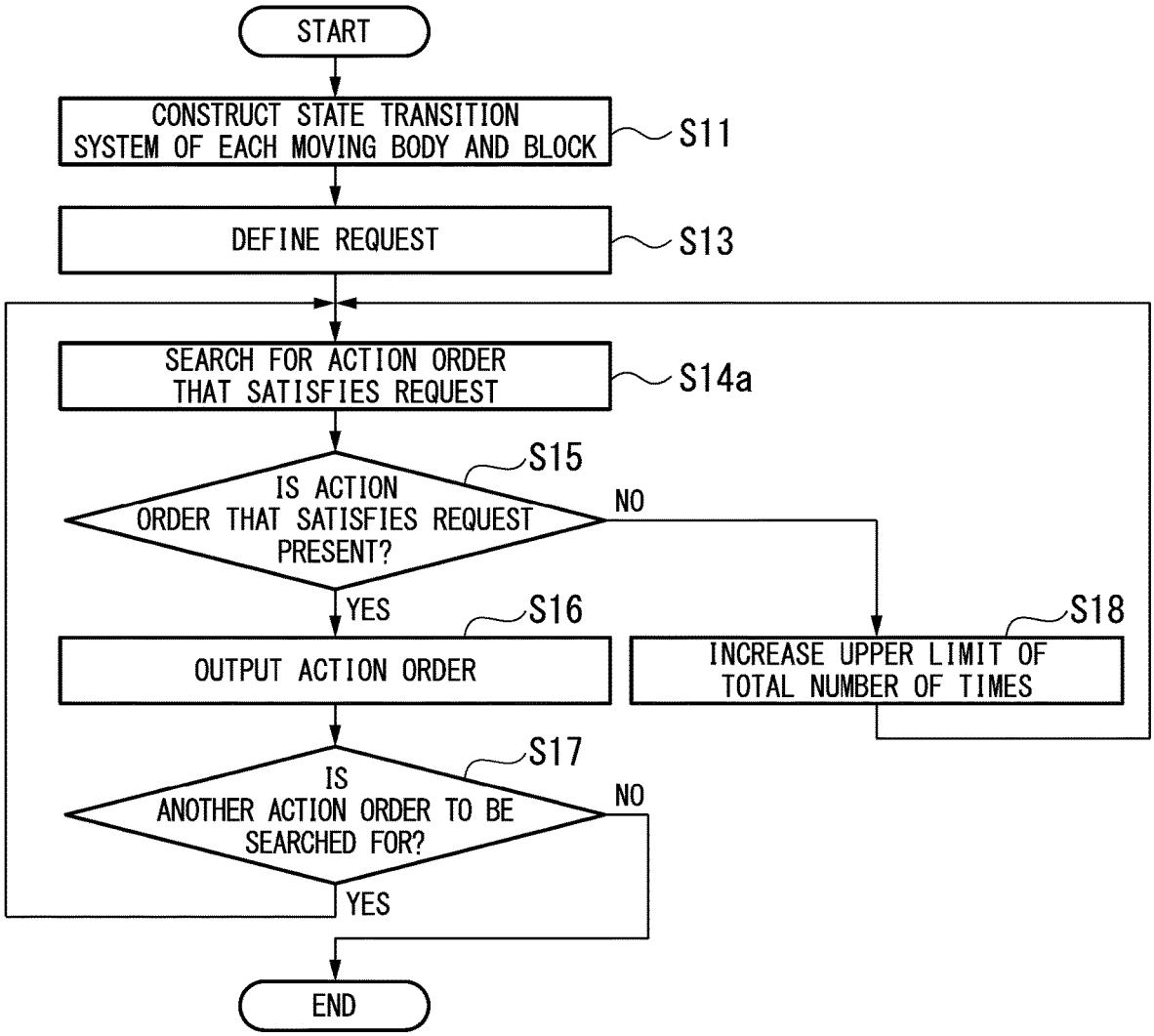
FIG. 17 is a second flowchart illustrating an example of the processing of generating the route control program according to the third embodiment of the present invention.

FIG. 17 is a second flowchart illustrating an example of processing of generating a route control program according to the third embodiment of the present invention. Processing that is similar to that in the second embodiment will be briefly described.

First, the environment model construction unit 11*b* constructs a state transition system in which the position of each moving body and the booking conditions of each block are comprehensively changed (Step S11). Next, the request setting unit 12 sets a request in regard to movement of the moving body X (Step S13).

Next, the search unit 13*b* searches for an action order that satisfies the request for the moving body that is a control target and other moving bodies (Step S14*a*). The search unit 13*b* performs the searching by causing the state to transition to match the restriction condition α or the restriction condition α and any of and the restriction conditions 1 to 4. Next, the search unit 13*b* determines whether or not an action order that satisfies the request is present (Step S15). In a case in which an action order that satisfies the request is present (Step S15: Yes), the output unit 15 outputs the action order searched for by the search unit 13*b* to the monitor (Step S16). In a case in which another action order is to be searched for (Step S17: Yes), the search unit 13*b* searches for another action order that satisfies the request (Step S14*a*). In a case in which another action order is not to be searched for (Step S17: No), the generation device 10*a* ends the processing of generating the route control program. In a case in which the action order that satisfies the request is not found even after all the patterns are searched for (Step S15: No), the search unit 13*a* determines that there is no solution. The search unit 13*b* determines that there is no solution. In the case of no solution, the environment model construction unit 11*b* adds one to the upper limit value of the total number of times of booking and cancellation of booking. Then, the generation device 10*b* repeats the processing in and after Step S14*a* again. It is thus possible to limit the search space and to shorten the calculation time.

Fourth Embodiment

Next, processing of generating a route control program according to a fourth embodiment will be described with reference to FIGS. 18 and 19.

Figure 18:
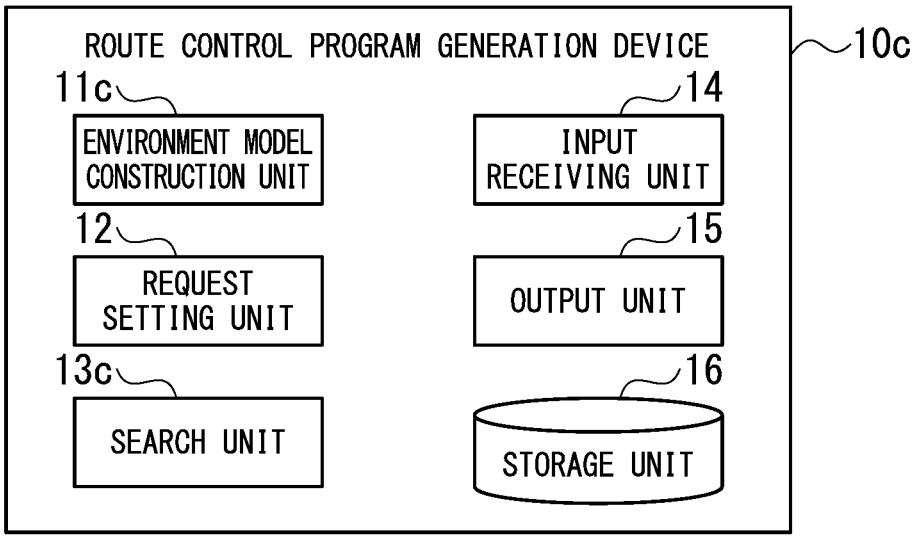
FIG. 18 is a diagram illustrating an example of a route control program generation device according to a fourth embodiment of the present invention.

FIG. 18 is a diagram illustrating an example of a route control program generation device according to the fourth embodiment of the present invention.

Processing and configurations similar to those in the first embodiment will be briefly described.

The route control program generation device 10*c* includes an environment model construction unit 11*c*, a request setting unit 12, a search unit 13*c*, an input receiving unit 14, an output unit 15, and a storage unit 16. Functions of the request setting unit 12, the input receiving unit 14, the output unit 15, and the storage unit 16 are similar to those in the first embodiment.

The environment model construction unit 11*c* constructs a state transition system constituted by a combination of all patterns of a track, positions of a moving body that is a control target and a moving body other than the control target, and booking conditions of each block. Moreover, the environment model construction unit 11*c* has a function of constructing an environment model by selecting a state that satisfies a restriction condition β, which will be described later, in the constructed state transition system.

The search unit 13*c* searches for an action order of the moving body that satisfies a safety condition and a goal condition for the environment model constructed by the environment model construction unit 11*c*. Moreover, the search unit 13*c* has a function of searching for an action order in a limited search range, to which the restriction condition β is applied, as a target at the time of searching for the action order.

Next, the restriction condition will be described with reference to FIG. 19.

Figure 19:
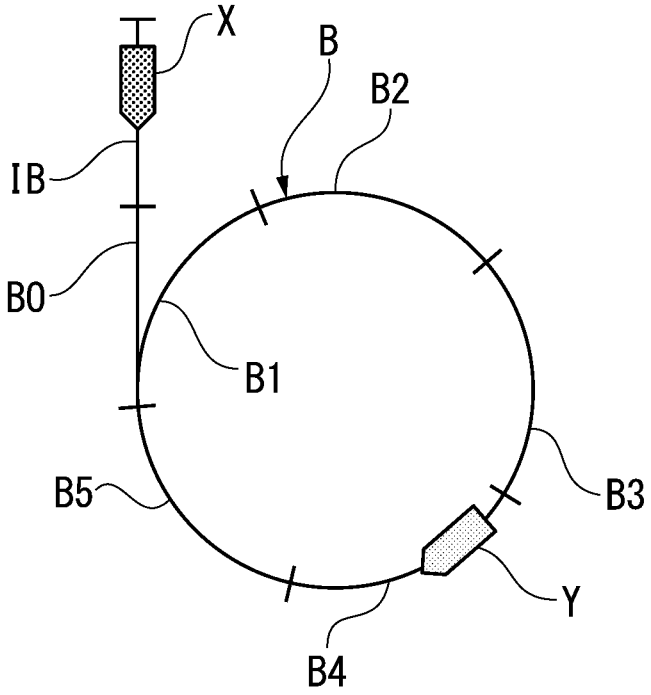
FIG. 19 is a diagram showing a restriction condition according to the fourth embodiment of the present invention.
Figure 20:
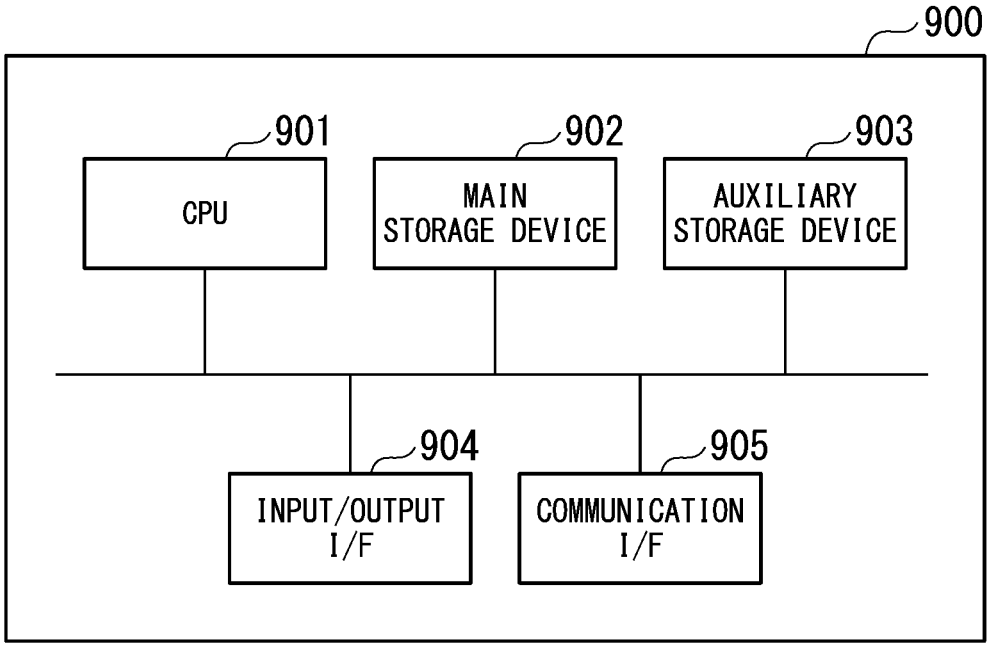
FIG. 20 is a diagram illustrating an example of a hardware configuration of the route control program generation device according to each embodiment of the present invention.

FIG. 19 is a diagram showing a restriction condition according to the fourth embodiment of the present invention.

In the fourth embodiment, the following restriction is added to booking and cancellation of booking that can be executed for at least one of the moving bodies X and Y in one logical time period in FIG. 19.

(β1) Occurrence of booking of a certain block is up to once in one logical time period.

(β2) The number of occurrences of cancelation of booking of a certain block is one or less in one logical time period.

(β3) In a case in which booking or cancellation of booking of a certain block occurs, the other action does not occur in the same logical time period.

In the fourth embodiment, the actions that can be selected for one moving body in one logical time period is one-time movement or waiting, one-time booking of a block for each block (β1), or one-time cancellation of booking for each block (β2), and it is not possible to select booking of the same block and cancellation of booking right after the booking, or cancellation of booking and booking right after the cancellation of the same block (β3). (Although it is possible to perform any of one-time booking and cancellation of booking of each block before one-time movement or waiting, actions after the one-time movement or waiting cannot be performed.) These β1 to β3 are included in the restriction condition β. For example, the moving body X cannot book the block B5 and cancel the booking of the block B5 right after the booking in one logical time period (β3).

According to the restriction condition β, it is possible to reduce the search space and to shorten the calculation time required for the searching without setting an appropriate upper limit value. Although it is not possible to exclude an action of repeating booking and cancellation of booking of the same block within a range that does not exceed the upper limit value in the third embodiment, it is possible to completely exclude the unnecessary action by the restriction condition β.

A flow of the processing of generating a route control program according to the fourth embodiment is similar to that described in FIG. 10. In the case of the fourth embodiment, the environment model construction unit 11*c* constructs the environment model with only the state of the environment model that satisfies the restriction condition β left in Step S12. Alternatively, the generation device 10*c* may generate a route control program in a procedure similar to that of the processing described in FIG. 12. In this case, the search unit 13*c* performs searching by selecting a state transition that satisfies the restriction condition β in Step S14*a* in FIG. 12.

Moreover, it is possible to combine the fourth embodiment with the first embodiment and the third embodiment. In other words, the environment model construction unit 11*c* may construct the environment model with only a state that satisfies the restriction conditions 1 to 4 described in the first embodiment and a part or an entirety of the restriction condition α described in the third embodiment in addition to the restriction condition β left in Step S12 in the flowchart in FIG. 10.

The fourth embodiment can be combined with the second embodiment and the third embodiment. In other words, the search unit 13*c* can perform the searching by causing the state to transition to satisfy the restriction conditions 1 to 4 described in the first embodiment and a part or an entirety of the restriction condition α described in the third embodiment in addition to the restriction condition β in Step S14*a* in the flowchart in FIG. 12.

Note that in relation to the fourth embodiment, a restriction condition that execution of both booking and cancellation of booking on one block in one logical time period is inhibited may be applied to one or more arbitrary blocks.

FIG. 13 is a diagram illustrating an example of a hardware configuration of the route program generation device according to each embodiment of the present invention.

A computer 900 is, for example, a personal computer (PC), a server terminal device, or the like including a CPU 901, a main storage device 902, an auxiliary storage device 903, an input/output interface 904, and a communication interface 905. The aforementioned route control program generation devices 10, 10*a*, 10*b*, and 10*c* are mounted in the computer 900. Also, the aforementioned operations of each processing unit are stored in the form of a program in the auxiliary storage device 903. The CPU 901 reads the program from the auxiliary storage device 903, develops the program in the main storage device 902, and executes the aforementioned processing in accordance with the program. The CPU 901 secures a storage region corresponding to the storage unit 16 in the main storage device 902 in accordance with the program. The CPU 901 secures a storage region for securing data during processing in the auxiliary storage device 903 in accordance with the program.

In at least one embodiment, the auxiliary storage device 903 is an example of a non-transitory tangible medium. Other examples of the non-transitory tangible medium include a magnetic disk, a magneto-optical disk, a CD-ROM, a DVD-ROM, a semiconductor memory, and the like connected via the input/output interface 904. In a case in which the program is distributed to the computer 900 through a communication line, the computer 900 that has received the distribution may develop the program in the main storage device 902 and execute the aforementioned processing. The program may be for realizing some of the aforementioned functions. Moreover, the program may be one for realizing the aforementioned functions in combination with another program that has already been stored in the auxiliary storage device 903, that is, a differential file (differential program).

In addition, it is possible to replace the components in the aforementioned embodiments with known components as needed without departing from the gist of the present invention. The technical scope of the present invention is not limited to the aforementioned embodiments, and various modifications can be added without departing from the gist of the present invention.

The moving body X is an example of the first moving body while the moving body Y is an example of the second moving body. The blocks B0 to B5, the block C0 to C9, and the blocks D0 to D4 are examples of the sections.

INDUSTRIAL APPLICABILITY

According to the route control program generation device, the route control program generation method, and the program described above, it is possible to reduce the calculation cost for generating a route control program.

REFERENCE SIGNS LIST

10, 10*a*, 10*b*, 10*c* Route control program generation device

11, 11*a*, 11*b*, 11*c* Environment model construction unit

12 Request setting unit
13, 13*a*, 13*b*, 13*c* Search unit
14 Input receiving unit
15 Output unit
16 Storage unit
900 Computer
901 CPU
902 Main storage device
903 Auxiliary storage device
904 Input/output interface
905 Communication interface

What is claimed is:

1. A route control program generation device comprising:
a non-transitory tangible medium storing a program; and
a processor configured to execute the program to cause the route control program generation device to:
construct a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body;
set a request constituted by a safety condition and a goal condition;
search for an order to reach a state of an environment model that satisfies the request for moving the first moving body to a prescribed section that is a goal without bringing the first moving body into a deadlock state with respect to the second moving body while changing a state of an environment model included in the group to a state of another environment model, wherein the group is constructed using the state of the environment model that matches a prescribed restriction condition on the basis of the restriction condition, wherein the search for the order comprises performing a state transition to a next state of the environment model until the next state that satisfies the request is achieved;
generate a route control program based on the order; and
output the route control program to a monitor to control a movement of the first moving body, the second moving body, or both by a railway system or a new transportation system; and
cause, based on the route control program, at least one of moving, waiting or both of the first moving body, moving, waiting or both of the second moving body to move, blocking of at least one section of the plurality of sections, cancelling of booking of one or more sections of the plurality of sections, or any combination thereof.

2. The route control program generation device according to claim 1,
wherein the searching is performed while performing the transition to the state of the environment model that matches a prescribed restriction condition on the basis of the restriction condition.

3. The route control program generation device according to claim 1, wherein the restriction condition is that the number of the sections to be booked is equal to or less than a prescribed value for at least one of the first moving body and the second moving body.

4. The route control program generation device according to claim 1, wherein the restriction condition is that the number of the sections that are able to be booked at the same time for one state transition is equal to or less than a prescribed value for at least one of the first moving body and the second moving body.

5. The route control program generation device according to claim 1, wherein the restriction condition is that the sections in a traveling direction are able to be booked while the other sections are not able to be booked for at least one of the first moving body and the second moving body.

6. The route control program generation device according to claim 1, wherein the restriction condition is that the sections up to a prescribed value counted from the currently present section in a traveling direction are able to be booked while the other sections are not able to be booked for at least one of the first moving body and the second moving body.

7. The route control program generation device according to claim 1,
wherein when elapse of a time corresponding to a change in state of the environment model when the first moving body or the second moving body moves to an adjacent one of the sections once is defined as one logical time period,
the restriction condition is that an upper limit of the number of times booking and cancellation of the booking that are executed in the one logical time period is provided for at least one of the first moving body and the second moving body.

8. The route control program generation device according to claim 7, wherein when not able to search for the order to reach the state of the environment model that satisfies the request, the group of environment models is constructed by increasing an upper limit of the number of times of the execution, and the order to reach the state of the environment model that satisfies the request is searched for.

9. The route control program generation device according to claim 1,
wherein when elapse of a time corresponding to a change in state of the environment model when the first moving body or the second moving body moves to an adjacent one of the sections once is defined as one logical time period,
the restriction condition is that execution of both the booking and the cancellation of the booking for one of the sections is inhibited in the one logical time period for at least one of the first moving body and the second moving body.

10. The route control program generation device according to claim 1,
wherein when elapse of a time corresponding to a change in state of the environment model when the first moving body or the second moving body moves to an adjacent one of the sections once is defined as one logical time period,
the restriction condition is that execution of both the booking and the cancellation of the booking for one of the sections is inhibited in the one logical time period.

11. The route control program generation device according to claim 1, wherein the environment model includes a plurality of second moving bodies.

12. A route control program generation method comprising:

constructing a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body;

setting a request constituted by a safety condition and a goal condition;

searching for an order to reach a state of an environment model that satisfies the request for moving the first moving body to a prescribed section that is a goal without bringing the first moving body into a deadlock state with respect to the second moving body while changing a state of an environment model included in the group to a state of another environment model, wherein the group is constructed using the state of the environment model that matches a prescribed restriction condition on the basis of the restriction condition, wherein the search for the order comprises performing a state transition to a next state of the environment model until the next state that satisfies the request is achieved;

generating a route control program based on the order; and outputting the route control program to a monitor to control a movement of the first moving body, the second moving body, or both by a railway system or a new transportation system; and causing, based on the route control program, at least one of moving, waiting or both of the first moving body, moving, waiting or both of the second moving body to move, blocking of at least one section of the plurality of sections, cancelling of booking of one or more sections of the plurality of sections, or any combination thereof.

13. The route control program generation method according to claim 12, wherein in the searching of the order, the searching is performed with transition to the state of the environment model that matches a prescribed restriction condition on the basis of the restriction condition.

14. A non-transitory computer readable medium of a computer storing a program, the program when executed by a processor of the computer causes the computer to perform one or more steps comprising:

constructing a group of a plurality of environment models with different states by changing the sections where a first moving body and a second moving body are present and the sections booked for each of the first moving body and the second moving body by performing the booking of the sections for the first moving body and the second moving body, cancellation of the booking and moving of the first moving body and the second moving body from the booked sections to other booked sections, wherein the environment model is constituted by a track divided into a plurality of sections, the first moving body that is a control target moving on the track and the second moving body other than the control target, and wherein a state of the environment model is determined by the sections where each of the first moving body and the second moving body is present and the sections booked for each of the first moving body and the second moving body;

setting a request constituted by a safety condition and a goal condition;

searching for an order to reach a state of an environment model that satisfies the request for moving the first moving body to a prescribed section that is a goal without bringing the first moving body into a deadlock state with respect to the second moving body while changing a state of an environment model included in the group to a state of another environment model, wherein in the constructing of the group, the group is constructed using the state of the environment model that matches a prescribed restriction condition on the basis of the restriction condition, wherein the search for the order comprises performing a state transition to a next state of the environment model until the next state that satisfies the request is achieved;

generating a route control program based on the order; and outputting the route control program to a monitor to control a movement of the first moving body, the second moving body, or both by a railway system or a new transportation system; and causing, based on the route control program, at least one of moving, waiting or both of the first moving body, moving, waiting or both of the second moving body to move, blocking of at least one section of the plurality of sections, cancelling of booking of one or more sections of the plurality of sections, or any combination thereof.

15. The non-transitory computer readable medium according to claim 14, wherein in the searching of the order, the searching is performed with transition to the state of the environment model that matches a prescribed restriction condition on the basis of the restriction condition.

* * * * *